US012696927B2

(12) United States Patent
Besso et al.

(10) Patent No.: US 12,696,927 B2
(45) Date of Patent: Aug. 4, 2026

(54) AEROSOL-GENERATING ARTICLE HAVING A WRAPPER

(71) Applicant: Philip Morris Products S.A., Neuchatel (CH)

(72) Inventors: Clement Besso, Neuchatel (CH); Frederic Ulysse Buehler, Neuchatel (CH); Stefan Lauenstein, Cormondreche (CH)

(73) Assignee: Philip Morris Products S.A., Neuchatel (CH)

( * ) Notice: Subject to any disclaimer, the term of this patent is extended or adjusted under 35 U.S.C. 154(b) by 390 days.

(21) Appl. No.: 18/253,445

(22) PCT Filed: Nov. 29, 2021

(86) PCT No.: PCT/EP2021/083424
§ 371 (c)(1),
(2) Date: May 18, 2023

(87) PCT Pub. No.: WO2022/112573
PCT Pub. Date: Jun. 2, 2022

(65) Prior Publication Data

US 2023/0413895 A1 Dec. 28, 2023

(30) Foreign Application Priority Data

Nov. 27, 2020 (EP) ..... 20210457

(51) Int. Cl.
*A24D 1/20* (2020.01)
*A24B 15/30* (2006.01)
(Continued)

(52) U.S. Cl.
CPC ..... *A24D 1/20* (2020.01); *A24B 15/303* (2013.01); *A24D 1/02* (2013.01); *A24D 3/17* (2020.01)

(58) Field of Classification Search
CPC ..... A24D 1/02; A24D 1/20
See application file for complete search history.

(56) References Cited

U.S. PATENT DOCUMENTS 5,101,839 A * 4/1992 Jakob ..... A24D 1/00 131/194
6,019,106 A * 2/2000 Okusawa ..... A24D 1/02 131/365
(Continued)

FOREIGN PATENT DOCUMENTS

CN 102273728 A 12/2011
CN 103108745 A 5/2013
(Continued)

OTHER PUBLICATIONS

Notice of Allowance issued on Sep. 11, 2024 in European Patent Application No. 21 823 256.9, 52 pages.
(Continued)

*Primary Examiner* — Eric Yaary
(74) *Attorney, Agent, or Firm* — Oblon, McClelland, Maier & Neustadt, L.L.P.

(57) ABSTRACT

An aerosol-generating article for producing an inhalable aerosol upon heating is provided, the aerosol-generating article including: a rod of aerosol-generating substrate including an aerosol former content of at least about 5 percent on a dry weight basis; and a wrapper wrapped around at least a portion of the aerosol-generating article, the wrapper including an embossed portion circumscribing at least the rod of aerosol-generating substrate, the embossed portion of the wrapper circumscribing the rod of aerosol-generating substrate along at least 80 percent of a length of the rod.

20 Claims, 2 Drawing Sheets

(51) Int. Cl.
*A24D 1/02* (2006.01)
*A24D 3/17* (2020.01)

(56) References Cited

U.S. PATENT DOCUMENTS

| | | | | |
|---|---|---|---|---|
| 8,151,805 | B2 * | 4/2012 | Takeda | A24D 1/02 131/365 |
| 2013/0139837 | A1 | 6/2013 | Kaljura et al. | |
| 2014/0366901 | A1 * | 12/2014 | Shinozaki | A24C 5/46 131/335 |
| 2015/0272203 | A1 | 10/2015 | Holford et al. | |
| 2016/0150825 | A1 * | 6/2016 | Mironov | H05B 6/105 219/634 |
| 2018/0007959 | A1 | 1/2018 | Lavanchy et al. | |
| 2018/0360111 | A1 | 12/2018 | Lavanchy et al. | |
| 2019/0208827 | A1 * | 7/2019 | Mironov | A24F 40/42 |
| 2020/0015520 | A1 | 1/2020 | Lavanchy et al. | |
| 2021/0244079 | A1 | 8/2021 | Iadanza et al. | |
| 2021/0337859 | A1 * | 11/2021 | Cheong | A24D 3/17 |
| 2023/0250590 | A1 * | 8/2023 | Zitturi | D21H 17/28 162/135 |

FOREIGN PATENT DOCUMENTS

| | | | |
|---|---|---|---|
| CN | 107427060 | A | 12/2017 |
| EP | 0 822 670 | B1 | 11/2005 |
| EP | 3 187 057 | A1 | 7/2017 |
| JP | 6-46818 | A | 2/1994 |
| JP | 10-99067 | A | 4/1998 |
| JP | 11-266851 | A | 10/1999 |
| JP | 2018-514194 | A | 6/2018 |
| RU | 2 677 086 | C2 | 6/2018 |
| WO | WO 2013/094681 | A1 | 6/2013 |
| WO | WO 2015/176898 | A1 | 11/2015 |
| WO | WO 2016/188649 | A1 | 12/2016 |
| WO | WO 2017/207586 | A1 | 12/2017 |
| WO | WO 2018/122060 | A1 | 7/2018 |
| WO | WO 2018/122070 | A1 | 7/2018 |
| WO | WO 2019/106040 | A1 | 6/2019 |
| WO | WO 2019/162504 | A1 | 8/2019 |
| WO | WO 2020/002165 | A1 | 1/2020 |
| WO | WO 2021/170642 | A1 | 9/2021 |
| WO | WO 2021/170651 | A1 | 9/2021 |
| WO | WO 2022/112575 | A1 | 6/2022 |

OTHER PUBLICATIONS

Carmines et al., "Toxicological evaluation of glycerin as a cigarette ingredient", Food and Chemical Toxicology, 2005, vol. 43, pp. 1521-1539.

Barthwal et al., "Mechanically Robust Superamphiphobic Aluminum Surface with Nanopore-Embedded Microtexture", Langmuir, 2013, vol. 29, pp. 11966-11974 (with cover sheet).

Combined Russian Office Action and Search Report issued Mar. 31, 2025 in Russian Patent Application No. 2023116071/03 (with Partial English Translation of Office Action only), 8 pages.

Extended European Search Report issued Apr. 23, 2021 in European Patent Application No. 20210457.6, 9 pages.

International Search Report and Written Opinion issued Apr. 4, 2022 in PCT/EP2021/083424 filed on Nov. 29, 2021, 5 pages.

International Preliminary Report on Patentability issued on Nov. 9, 2022 in PCT/EP2021/083424 filed on Nov. 29, 2021, 17 pages.

Combined Chinese Office Action and Search Report issued Sep. 19, 2025, in corresponding Chinese Patent Application No. 202180079621.1 (with English Translation, 13 pages.

Office Action dated Dec. 15, 2025, issued in the corresponding Japanese Patent Application No. 2023-530563.

Office Action dated Jan. 27, 2026, issued in the corresponding Chinese application No. 202180079621.1 (with English translation).

* cited by examiner

AEROSOL-GENERATING ARTICLE HAVING A WRAPPER

The present invention relates to aerosol-generating articles having a wrapper. The invention is particularly applicable to aerosol-generating articles comprising an aerosol-generating substrate and adapted to produce an inhalable aerosol upon heating.

Combustible aerosol-generating articles, such as cigarettes, typically comprise a cylindrical rod of tobacco cut filler surrounded by a wrapper and a cylindrical filter axially aligned in an abutting end-to-end relationship with the wrapped tobacco rod. The cylindrical filter typically comprises a filtration material circumscribed by a plug wrap. The wrapped tobacco rod and the filter are joined by a band of tipping wrapper, normally formed of a paper material that circumscribes the entire length of the filter and an adjacent portion of the tobacco rod. A cigarette is employed by a consumer by lighting one end thereof and burning the shredded tobacco rod. The smoker then receives mainstream smoke into their mouth by drawing on the mouth end or filter end of the cigarette.

Aerosol-generating articles in which an aerosol-generating substrate, such as a tobacco-containing substrate, is heated rather than combusted, are known in the art.

Typically, in such heated aerosol-generating articles an aerosol is generated by the transfer of heat from a heat source to a physically separate aerosol-generating substrate or material, which may be located in contact with, within, around, or downstream of the heat source. During use of the aerosol-generating article, volatile compounds are released from the aerosol-generating substrate by heat transfer from the heat source and are entrained in air drawn through the aerosol-generating article. As the released compounds cool, they condense to form an aerosol.

A number of prior art documents disclose aerosol-generating devices for consuming aerosol-generating articles. Such devices include, for example, electrically heated aerosol-generating devices in which an aerosol is generated by the transfer of heat from one or more electrical heater elements of the aerosol-generating device to the aerosol-generating substrate of a heated aerosol-generating article. For example, electrically heated aerosol-generating devices have been proposed that comprise an internal heater blade which is adapted to be inserted into the aerosol-generating substrate. As an alternative, inductively heatable aerosol-generating articles comprising an aerosol-generating substrate and a susceptor element arranged within the aerosol-generating substrate have been proposed by WO 2015/176898.

It is generally known to wrap an aerosol-generating substrate in a wrapper. A wrapper can help to keep the aerosol-generating substrate in place. The wrapper can also provide a barrier between the aerosol-generating substrate and the user. It is generally known that a thicker wrapper can be more effective at carrying out these functions. However, thicker wrappers can present difficulties when it comes to the manufacturing and assembly of aerosol-generating articles.

Therefore, it would be desirable to provide a wrapper that is sufficient to hold the aerosol-generating substrate in place whilst also being suitable for high speed manufacture. Presently, there is a limit on the range of materials and properties of wrappers that can be used for such purposes. It would also be desirable to minimise the interaction between the wrapper and the aerosol-generating substrate as this in turn minimises the interaction between the user and the aerosol-generating substrate.

The present disclosure relates to an aerosol-generating article for producing an inhalable aerosol upon heating. The aerosol-generating article may comprise a rod of aerosol-generating substrate. The rod of aerosol-generating substrate may comprise an aerosol former. The aerosol-generating article may further comprise a wrapper wrapped around at least a portion of the aerosol-generating article. The wrapper may comprise an embossed portion. The embossed portion may circumscribe at least the rod of aerosol-generating substrate.

According to the invention there is provided an aerosol-generating article for producing an inhalable aerosol upon heating, the aerosol-generating article comprising: a rod of aerosol-generating substrate comprising an aerosol former; and a wrapper wrapped around at least a portion of the aerosol-generating article. The wrapper comprises an embossed portion circumscribing at least the rod of aerosol-generating substrate.

The term "aerosol-generating article" is used herein to denote an article wherein an aerosol-generating substrate is heated to produce an deliver inhalable aerosol to a consumer. As used herein, the term "aerosol-generating substrate" denotes a substrate capable of releasing volatile compounds upon heating to generate an aerosol.

A conventional cigarette is lit when a user applies a flame to one end of the cigarette and draws air through the other end. The localised heat provided by the flame and the oxygen in the air drawn through the cigarette causes the end of the cigarette to ignite, and the resulting combustion generates an inhalable smoke. By contrast, in heated aerosol-generating articles, an aerosol is generated by heating a flavour generating substrate, such as tobacco. Known heated aerosol-generating articles include, for example, electrically heated aerosol-generating articles and aerosol-generating articles in which an aerosol is generated by the transfer of heat from a combustible fuel element or heat source to a physically separate aerosol forming material. For example, aerosol-generating articles according to the invention find particular application in aerosol-generating systems comprising an electrically heated aerosol-generating device having an internal heater blade which is adapted to be inserted into the rod of aerosol-generating substrate. Aerosol-generating articles of this type are described in the prior art, for example, in EP 0822670.

As used herein, the term "aerosol-generating device" refers to a device comprising a heater element that interacts with the aerosol-generating substrate of the aerosol-generating article to generate an aerosol.

As used herein, the term "basis weight" is a measure of mass per unit area, in grams per square meter. In other words, basis weight is a measure of areal density. Basis weight may also be referred to as grammage.

As used herein with reference to the present invention, the term "rod" is used to denote a generally cylindrical element of substantially circular, oval or elliptical cross-section.

The terms "distal," "upstream," "proximal," and "downstream" are used to describe the relative positions of components, or portions of components, of an aerosol generating system. Aerosol generating systems according to the invention have a proximal end through which, in use, an aerosol exits the system for delivery to a user, and have an opposing distal end. The proximal end of the aerosol generating article may also be referred to as the mouth end. In use, a user draws on the proximal end of the aerosol generating article in order to inhale an aerosol generated by the aerosol generating article. The terms upstream and downstream are relative to the direction of aerosol movement through the aerosol generating article when a user draws on the proximal end.

As used herein, the term "longitudinal" refers to the direction corresponding to the main longitudinal axis of the aerosol-generating article, which extends between the upstream and downstream ends of the aerosol-generating article. As used herein, the terms "upstream" and "downstream" describe the relative positions of elements, or portions of elements, of the aerosol-generating article in relation to the direction in which the aerosol is transported through the aerosol-generating article during use.

During use, air is drawn through the aerosol-generating article in the longitudinal direction. The term "transverse" refers to the direction that is perpendicular to the longitudinal axis. Any reference to the "cross-section" of the aerosol-generating article or a component of the aerosol-generating article refers to the transverse cross-section unless stated otherwise.

The term "length" denotes the dimension of a component of the aerosol-generating article in the longitudinal direction. For example, it may be used to denote the dimension of the rod or of the elongate tubular elements in the longitudinal direction.

The term "wrapper" or "paper wrapper" are interchangeable and refer to a wrapping material that circumscribes an aerosol-generating substrate to maintain the shape of the aerosol-generating substrate and is formed of paper or other material and optional filler materials.

As used herein in relation to the wrapper, the terms "inner" and "outer" when describing surfaces of the wrapper, refer to the orientation of the wrapper with respect to the aerosol-generating article. The wrapper may be wrapped such that the inner surface of the wrapper faces the aerosol-generating article and the outer surface faces away from the aerosol-generating article.

The term "embossment" is used herein to refer to protrusions formed in the surface of a wrapper. These protrusions may be carved, moulded or stamped into the wrapper. The portion of wrapper carrying such embossments is said to be embossed. The sections of the wrapper that do not form embossments and do not protrude from the wrapper are herein referred to as "debossments".

As used herein, the term "water resistant" refers to wrapper exhibiting moisture resistant properties. One useful way to determine this is to measure the water contact angle. The "water contact angle" is the angle, conventionally measured through the liquid, where a liquid/vapour interface meets a solid surface. It quantifies the wettability of a solid surface by a liquid via the Young equation. Hydrophobicity or water contact angle may be determined by utilizing TAPPI T558 test method and the result is presented as an interfacial contact angle and reported in "degrees" and can range from near zero to near 180 degrees.

The wrapper of the present invention provides an improved component for an aerosol-generating article. By providing a wrapper with an embossed portion circumscribing at least the rod of aerosol-generating substrate, interaction between the inner surface of the wrapper and rod of aerosol-generating substrate can be reduced. For example, the embossed portion may reduce the amount of contact between the inner surface of the wrapper and rod of aerosol-generating substrate. This may advantageously help to reduce the extent to which moisture can be transferred between the rod of aerosol-generating substrate and the wrapper. This may also advantageously help to reduce the extent to which heat can be transferred between the rod of aerosol-generating substrate and the wrapper.

The wrapper configuration of the present invention may also advantageously help to reduce the extent to which heat can be transferred between the rod of aerosol-generating substrate and an aerosol-generating device used with the aerosol-generating article. This is particularly advantageous when the aerosol-generating substrate is heated by a heat source within the aerosol-generating substrate, such as one or both of a susceptor element and heating blade, and when at least a portion of the aerosol-generating device surrounds the portion of the aerosol-generating article comprising the aerosol-generating substrate. Such advantages may also be desirable when the rod of aerosol-generating substrate is heated by a heating element upstream of the aerosol-generating substrate.

The insulating properties of the embossed portion of the wrapper may be advantageous from an energy efficiency perspective, for example, by preventing unwanted loss of heat from the aerosol-generating article.

By providing a wrapper with an embossed portion circumscribing at least the rod of aerosol-generating substrate, it is possible to wrap one or both of a thicker and a higher basis weight wrapper around the rod of aerosol-generating substrate, whilst still enabling the aerosol-generating article to be manufactured at high speed. This is because the embossments in the wrapper may impart similar bending and curling properties to a thicker wrapper as those of a conventional wrapper.

By providing a thicker wrapper around the rod of aerosol-generating substrate, the structural integrity of the aerosol-generating article can be maintained. This is because a thicker wrapper can be more resistant to one or both of moisture and heat originating from the heated rod of aerosol-generating substrate. The aerosol-generating article is therefore less likely to deform during use.

Additionally, by providing a wrapper with an embossed portion the structural integrity of the aerosol-generating article may be further improved. This is because the reduced interaction between the aerosol-generating substrate and the wrapper, as discussed above, further reduces the likelihood of the aerosol-generating article deforming during use.

The reduced interaction between the wrapper and the rod of aerosol-generating article may also help to reduce the likelihood of one or both of moisture and heat being transferred from the aerosol-generating substrate to the exterior of the aerosol-generating article.

The aerosol-generating article may have a paper wrapper wrapped around at least a portion of the aerosol-generating article. The wrapper may have a basis weight which is greater than that of conventional wrappers for aerosol-generating articles generally known in the art. The higher basis weight wrapper may act as an improved barrier between one surface of the wrapper and the other surface of the wrapper. The higher basis weight wrapper may slow or reduce the transfer of one or both of moisture and heat through the wrapper. This can help to maintain the structural integrity of the wrapper and the aerosol-generating article. The paper wrapper may have a basis weight of from 50 grams per square meter to 100 grams per square meter.

The aerosol-generating article may comprise a plurality of segments or components. The plurality of segments or components may be assembled together longitudinally. The plurality of segments may be assembled in the form of a rod. The plurality of segments may include the rod of aerosol-generating substrate. The plurality of segments may include one or more of the following components, each of which is described in more detail below: an upstream element, a mouthpiece element, a support element and an aerosol-cooling element. The plurality of segments may include one or both of a cavity and a filter segment. A filter segment may be a plug of fibrous filtration material, such as cellulose acetate. A filter segment may be a hollow tube of fibrous filtration material, such as a hollow acetate tube.

As noted above, the aerosol-generating article may comprise a paper wrapper wrapped around at least a portion of the aerosol-generating article. The paper wrapper may therefore be wrapped around one or more segments or components of the aerosol-generating article, such as one or more of a rod of aerosol-forming substrate, an upstream element, a mouthpiece element, a support element, an aerosol-cooling element, a filter segment, and a cavity. In some embodiments, the paper wrapper is wrapped around all segments of the aerosol-generating article. In some embodiments, the paper wrapper is wrapped around only some of the segments of the aerosol-generating article. Preferably, the paper wrapper is wrapped around at least two segments of the aerosol-generating article. Preferably, the paper wrapper is wrapped around the rod of aerosol-forming substrate and at least one other segment of the aerosol-generating article.

As noted above, the wrapper may comprise an embossed portion circumscribing at least the rod of aerosol-generating substrate. The embossed portion may circumscribe only the rod of aerosol-generating substrate. The embossed portion may circumscribe the rod of aerosol-generating substrate as well as one or more other portions of the aerosol-generating article, such as one or more other portions of the aerosol-generating article which are adjacent to the rod of aerosol-generating substrate. These other portions or components of the aerosol-generating article are described in more detail below and include but are not limited to: the upstream element, and components of the downstream section, including the mouthpiece element, the support element and the aerosol-cooling element.

The embossed portion of the wrapper may be a water resistant wrapper. A water resistant wrapper may provide an additional barrier against moisture from the rod of aerosol-generating substrate. The embossed portion may have an inner surface which is water resistant. Where the inner surface of the embossed portion of the wrapper is water resistant, moisture from the rod of aerosol-generating substrate may be prevented from penetrating into the wrapper. This may help to reduce one or more of swelling, visible staining, and physical weakening of the wrapper. This may also help to maintain the structural integrity of the aerosol-generating article. Reducing or preventing swelling of the aerosol generating article may improve the usability of the aerosol generating article by allowing secure insertion and removal of the aerosol generating article from a heating device, with a reduced risk of damaging the aerosol generating article.

One useful way to determine the water resistant properties of a wrapper is to measure the water contact angle. The "water contact angle" is the angle, conventionally measured through the liquid, where a liquid/vapour interface meets a solid surface. It quantifies the wettability of a solid surface by a liquid via the Young equation. Hydrophobicity or water contact angle may be determined by utilizing TAPPI T558 test method and the result is presented as an interfacial contact angle and reported in "degrees" and can range from near zero to near 180 degrees. The water resistant inner surface of the embossed portion of the wrapper may have a water contact angle of at least 30 degrees. Preferably, the water resistant inner surface of the embossed portion of the wrapper has a water contact angle of at least 40 degrees. More preferably, the water resistant inner surface of the embossed portion of the wrapper has a water contact angle of at least 45 degrees.

The embossed portion of the wrapper may directly circumscribe the rod of aerosol-generating substrate. Where the embossed portion of the wrapper directly circumscribes the rod of aerosol-generating substrate, the embossed portion of the wrapper is in direct contact with the rod of aerosol-generating article.

The embossed portion of the wrapper may indirectly circumscribe the rod of aerosol-generating substrate. Where the embossed portion of the wrapper indirectly circumscribes the rod of aerosol-generating substrate, one or more additional layers may be disposed between the embossed portion of the wrapper and the rod of aerosol-generating substrate. The one or more additional layers may be formed by one or more additional wrappers.

The embossed portion of the wrapper may fully circumscribe the rod of aerosol-generating substrate around the circumference of the rod.

The embossed portion of the wrapper may circumscribe the rod of aerosol-generating substrate around only a portion of the circumference of the rod. Where the embossed portion of the wrapper circumscribes the rod of aerosol-generating substrate around only a portion of the circumference of the rod, the embossed portion of the wrapper may circumscribe the rod of aerosol-generating substrate around no more than 80 percent of the circumference of the rod. Where the embossed portion of the wrapper circumscribes the rod of aerosol-generating substrate around only a portion of the circumference of the rod, the embossed portion of the wrapper may circumscribe the rod of aerosol-generating substrate around at least 20 percent of the circumference of the rod.

The embossed portion of the wrapper may circumscribe the rod of aerosol-generating substrate along at least 80 percent of the length of the rod. Preferably, the embossed portion of the wrapper circumscribes the rod of aerosol-generating substrate along at least 90 percent of the length of the rod. More preferably, the embossed portion of the wrapper circumscribes the rod of aerosol-generating substrate along 100 percent of the length of the rod.

The embossed portion of the wrapper may extend along the full length of the wrapper. The embossed portion of the wrapper may only extend along a portion of the wrapper. Where the embossed portion extends along only a portion of the wrapper, the embossed portion may extend along no more than 80 percent of the length of the wrapper. Where the embossed portion extends along only a portion of the wrapper, the embossed portion may extend along at least 20 percent of the length of the wrapper.

The embossed portion of the wrapper may have an embossed outer surface and a debossed inner surface. The embossed outer surface may be characterised by one or more embossments that protrude and are spaced away from the plane of the wrapper. The surface area of the embossed portion of the wrapper in contact with the rod of aerosol-generating substrate is therefore reduced. This can help to provide improved resistance to one or both of moisture and heat from the aerosol-generating substrate. The debossed inner surface may be characterised by one or more debossments, which correspond to an area or areas where the wrapper has not been embossed. These debossments are in the same plane as the wrapper. The debossments on the inner surface may be in direct or indirect contact with the rod of aerosol-generating substrate. The plane of the wrapper is taken when the wrapper is an unrolled state.

The embossed portion of the wrapper may have a basis weight which is greater than conventional wrappers for aerosol-generating articles generally known in the art. The thicker wrapper may slow or reduce the transfer of one or both of moisture and heat through the wrapper. This can help to maintain the structural integrity of the aerosol-generating article and further improve the resistance of the wrapper to one or both of moisture and heat from the rod of aerosol-generating substrate. The embossed portion of the wrapper may have a basis weight of from 50 grams per square meter to 100 grams per square meter. Preferably, the embossed portion of the wrapper has a basis weight of from 60 grams per square meter to 90 grams per square meter. More preferably, the embossed portion of the wrapper has a basis weight of from 75 grams per square meter to 80 grams per square meter.

The embossed portion of the wrapper may have a plurality of embossments.

Where the embossed portion of the wrapper has a plurality of embossments, each embossment may have a depth of from 0.07 millimetres to 0.21 millimetres, preferably from 0.10 millimetres to 0.18 millimetres and more preferably from 0.12 millimetres to 0.16 millimetres. Each embossment may also have a pitch of from 0.2 millimetres to 0.4 millimetres, preferably from 0.25 millimetres to 0.35 millimetres, more preferably from 0.275 millimetres to 0.325 millimetres.

The embossments may be in the shape of spherical domes. Where each embossment is a spherical dome, the angle between the tangent to the spherical dome and the interception to the horizontal wrap line may be from 30 degrees to 60 degrees. The plurality of embossments may be spaced apart in a repeating pattern. This spaced apart repeating pattern of embossments with substantially the same depth, pitch, and profile may help to ensure uniform water and heat resistance properties along the surface of the embossed portion of the wrapper.

The embossed portion of the wrapper may have a bending moment of from 3 centinewton centimetres to 8 centinewton centimetres at 90 degrees. Preferably, the embossed portion of the wrapper has a bending moment of from 4 centinewton centimetres to 7 centinewton centimetres at 90 degrees. More preferably, the embossed portion of the wrapper has a bending moment of from 4 centinewton centimetres to 6 centinewton centimetres at 90 degrees.

The embossed portion of the wrapper may have an angle memory of from 10 degrees to 40 degrees after 90 degrees bending. Preferably the embossed portion of the wrapper has an angle memory of from 15 degrees to 35 degrees after 90 degrees bending. More preferably, the embossed portion of the wrapper has an angle memory of from 20 degrees to 30 degrees after 90 degrees bending.

The bending moment and angle memory of the wrapper are measured according to the Bending Stiffness test by Schlenker following the DIN 53864 (August 1978) standard with a suitable Bending Strength Testing Apparatus, for example, as supplied by Frank Prufgerate Gmbh. The bending moment in the sense of this standard DIN 53864, is the torque required to bend the test sample (Paper Material) by a certain angle (90 degrees) at a certain clamping length (20 millimetres). The angle memory, in the sense of this standard DIN 53864, is the remaining angle of the test sample after the bending moment test has been carried out. A large angle signifies that the sample has good dead fold properties.

The bending and curling properties defined above may be similar to those of a conventional wrapper. By having an embossed portion of the wrapper with the bending and curling properties defined above, it may be possible to wrap the thicker wrapper around the rod of aerosol-generating substrate, whilst still enabling the aerosol-generating article to be manufactured at high speed.

The aerosol-generating article of the present invention may comprise a rod of aerosol generating substrate. The rod of aerosol-generating substrate may comprise a gel composition. The gel composition may comprise at least one gelling agent, at least one of an alkaloid compound and a cannabinoid compound, and an aerosol former. The aerosol-generating substrate may comprise a gel composition that includes nicotine.

The rod of aerosol-generating substrate may comprise one or more aerosol formers. Upon volatilisation, an aerosol former can convey other vaporised compounds released from the rod of aerosol-generating substrate upon heating, such as nicotine and flavourants, in an aerosol. Suitable aerosol formers for inclusion in the rod of aerosol-generating substrate are known in the art and include, but are not limited to: polyhydric alcohols, such as triethylene glycol, propylene glycol, 1,3-butanediol and glycerol; esters of polyhydric alcohols, such as glycerol mono-, di- or triacetate; and aliphatic esters of mono-, di- or polycarboxylic acids, such as dimethyl dodecanedioate and dimethyl tetradecanedioate.

The rod of aerosol-generating substrate may comprise an aerosol former content of at least 10 percent on a dry weight basis. The rod of aerosol-generating substrate may comprise an aerosol former content of at least 15 percent on a dry weight basis. The rod of aerosol-generating substrate may comprise an aerosol former content of at least 20 percent on a dry weight basis. The rod of aerosol-generating substrate may comprise an aerosol former content of at least 30 percent on a dry weight basis. The rod of aerosol-generating substrate may comprise an aerosol former content of at least 40 percent on a dry weight basis. The rod of aerosol-generating substrate may comprise an aerosol former content of at least 50 percent on a dry weight basis. The rod of aerosol-generating substrate may comprise an aerosol former content of at least 60 percent on a dry weight basis. The rod of aerosol-generating substrate may comprise an aerosol former content of at least 70 percent on a dry weight basis. The rod of aerosol-generating substrate may comprise an aerosol former content of at least 80 percent on a dry weight basis. The rod of aerosol-generating substrate may comprise an aerosol former content of at least 90 percent on a dry weight basis.

The rod of aerosol-generating substrate may have an aerosol former content of between about 5 percent and about 30 percent by weight on a dry weight basis, such as between about 10 percent and about 25 percent by weight on a dry weight basis, or between about 15 percent and about 20 percent by weight on a dry weight basis.

For example, if the substrate is intended for use in an aerosol-generating article for an electrically-operated aerosol-generating system having a heating element, it may preferably include an aerosol former content of between about 5 percent to about 30 percent by weight on a dry weight basis. If the substrate is intended for use in an aerosol-generating article for an electrically-operated aerosol-generating system having a heating element, the aerosol former is preferably glycerol.

The rod of aerosol-generating substrate may have an aerosol former content of about 1 percent to about 5 percent by weight on a dry weight basis. For example, if the substrate is intended for use in an aerosol-generating article in which aerosol former is kept in a reservoir separate from the substrate, the substrate may have an aerosol former content of greater than 1 percent and less than about 5 percent. In such embodiments, the aerosol former is volatilised upon heating and a stream of the aerosol former is contacted with the aerosol-generating substrate so as to entrain the flavours from the aerosol-generating substrate in the aerosol.

The aerosol-generating substrate may have an aerosol former content of about 30 percent by weight to about 45 percent by weight. This relatively high level of aerosol former is particularly suitable for aerosol-generating substrates that are intended to be heated at a temperature of less than 275 degrees Celsius. In such embodiments, the aerosol-generating substrate preferably further comprises between about 2 percent by weight and about 10 percent by weight of cellulose ether, on a dry weight basis and between about 5 percent by weight and about 50 percent by weight of additional cellulose, on a dry weight basis. The use of the combination of cellulose ether and additional cellulose has been found to provide a particularly effective delivery of aerosol when used in an aerosol-generating substrate having an aerosol former content of between 30 percent by weight and 45 percent by weight.

Preferably, the gel composition comprises an alkaloid compound, or a cannabinoid compound, or both an alkaloid compound and a cannabinoid compound; an aerosol former; and at least one gelling agent. Preferably, the at least one gelling agent forms a solid medium and the glycerol is dispersed in the solid medium, with the alkaloid or cannabinoid dispersed in the glycerol. Preferably, the gel composition is a stable gel phase.

Advantageously, a stable gel composition comprising nicotine provides predictable composition form upon storage or transit from manufacture to the consumer. The stable gel composition comprising nicotine substantially maintains its shape. The stable gel composition comprising nicotine substantially does not release a liquid phase upon storage or transit from manufacture to the consumer. The stable gel composition comprising nicotine may provide for a simple consumable design. This consumable may not have to be designed to contain a liquid, thus a wider range of materials and container constructions may be contemplated.

The gel composition described herein may be combined with an aerosol-generating device to provide a nicotine aerosol to the lungs at inhalation or air flow rates that are within conventional smoking regime inhalation or air flow rates. The aerosol-generating device may continuously heat the gel composition. A consumer may take a plurality of inhalations or "puffs" where each "puff" delivers an amount of nicotine aerosol. The gel composition may be capable of delivering a high nicotine/low total particulate matter (TPM) aerosol to a consumer when heated, preferably in a continuous manner.

The phrase "stable gel phase" or "stable gel" refers to gel that substantially maintains its shape and mass when exposed to a variety of environmental conditions. The stable gel may not substantially release (sweat) or absorb water when exposed to a standard temperature and pressure while varying relative humidity from about 10 percent to about 60 percent. For example, the stable gel may substantially maintain its shape and mass when exposed to a standard temperature and pressure while varying relative humidity from about 10 percent to about 60 percent.

The gel composition includes an alkaloid compound, or a cannabinoid compound, or both an alkaloid compound and a cannabinoid compound. The gel composition may include one or more alkaloids. The gel composition may include one or more cannabinoids. The gel composition may include a combination of one or more alkaloids and one or more cannabinoids.

The term "alkaloid compound" refers to any one of a class of naturally occurring organic compounds that contain one or more basic nitrogen atoms. Generally, an alkaloid contains at least one nitrogen atom in an amine-type structure. This or another nitrogen atom in the molecule of the alkaloid compound can be active as a base in acid-base reactions. Most alkaloid compounds have one or more of their nitrogen atoms as part of a cyclic system, such as for example a heterocylic ring. In nature, alkaloid compounds are found primarily in plants, and are especially common in certain families of flowering plants. However, some alkaloid compounds are found in animal species and fungi. In this disclosure, the term "alkaloid compound" refers to both naturally derived alkaloid compounds and synthetically manufactured alkaloid compounds.

The gel composition preferably includes an alkaloid compound selected from the group consisting of nicotine, anatabine, and combinations thereof.

Preferably the gel composition includes nicotine.

The term "nicotine" refers to nicotine and nicotine derivatives such as free-base nicotine, nicotine salts and the like.

The term "cannabinoid compound" refers to any one of a class of naturally occurring compounds that are found in parts of the cannabis plant—namely the species *Cannabis sativa, Cannabis indica*, and *Cannabis ruderalis*. Cannabinoid compounds are especially concentrated in the female flower heads. Cannabinoid compounds naturally occurring in the cannabis plant include cannabidiol (CBD) and tetrahydrocannabinol (THC). In this disclosure, the term "cannabinoid compounds" is used to describe both naturally derived cannabinoid compounds and synthetically manufactured cannabinoid compounds.

The gel may include a cannabinoid compound selected from the group consisting of cannabidiol (CBD), tetrahydrocannabinol (THC), tetrahydrocannabinolic acid (THCA), cannabidiolic acid (CBDA), cannabinol (CBN), cannabigerol (CBG), cannabichromene (CBC), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM), cannabielsoin (CBE), cannabicitran (CBT), and combinations thereof.

The gel composition preferably includes a cannabinoid compound selected from the group consisting of cannabidiol (CBD), THC (tetrahydrocannabinol) and combinations thereof.

The gel preferably includes cannabidiol (CBD).

The gel composition may include nicotine and cannabidiol (CBD).

The gel composition may include nicotine, cannabidiol (CBD), and THC (tetrahydrocannabinol).

The gel composition additionally includes an aerosol-former. Ideally the aerosol-former is substantially resistant to thermal degradation at the operating temperature of the associated aerosol-generating device. Suitable aerosol-formers include, but are not limited to: polyhydric alcohols, such as triethylene glycol, 1, 3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Polyhydric alcohols or mixtures thereof, may be one or more of triethylene glycol, 1, 3-butanediol and, glycerine (glycerol or propane-1,2,3-triol) or polyethylene glycol. The aerosol-former is preferably glycerol.

The gel composition may include a majority of an aerosol-former. The gel composition may include a mixture of water and the aerosol-former where the aerosol-former forms a majority (by weight) of the gel composition. The aerosol-former may form at least about 50 percent by weight of the gel composition. The aerosol-former may form at least about 60 percent by weight or at least about 65 percent by weight or at least about 70 percent by weight of the gel composition. The aerosol-former may form about 70 percent by weight to about 80 percent by weight of the gel composition. The aerosol-former may form about 70 percent by weight to about 75 percent by weight of the gel composition.

The gel composition may include a majority of glycerol. The gel composition may include a mixture of water and the glycerol where the glycerol forms a majority (by weight) of the gel composition. The glycerol may form at least about 50 percent by weight of the gel composition. The glycerol may form at least about 60 percent by weight or at least about 65 percent by weight or at least about 70 percent by weight of the gel composition. The glycerol may form about 70 percent by weight to about 80 percent by weight of the gel composition. The glycerol may form about 70 percent by weight to about 75 percent by weight of the gel composition.

The gel composition additionally includes at least one gelling agent.

The term "gelling agent" refers to a compound that homogeneously, when added to a 50 percent by weight water/50 percent by weight glycerol mixture, in an amount of about 0.3 percent by weight, forms a solid medium or support matrix leading to a gel. Gelling agents include, but are not limited to, hydrogen-bond crosslinking gelling agents, and ionic crosslinking gelling agents.

The gelling agent may include one or more biopolymers. The biopolymers may be formed of polysaccharides.

Preferably, the gel composition comprises at least about 0.2 percent by weight hydrogen-bond crosslinking gelling agent. Alternatively or in addition, the gel composition preferably comprises at least about 0.2 percent by weight ionic crosslinking gelling agent. Most preferably, the gel composition comprises at least about 0.2 percent by weight hydrogen-bond crosslinking gelling agent and at least about 0.2 percent by weight ionic crosslinking gelling agent. The gel composition may comprise about 0.5 percent by weight to about 3 percent by weight hydrogen-bond crosslinking gelling agent and about 0.5 percent by weight to about 3 percent by weight ionic crosslinking gelling agent, or about 1 percent by weight to about 2 percent by weight hydrogen-bond crosslinking gelling agent and about 1 percent by weight to about 2 percent by weight ionic crosslinking gelling agent. The hydrogen-bond crosslinking gelling agent and ionic crosslinking gelling agent may be present in the gel composition in substantially equal amounts by weight.

The term "hydrogen-bond crosslinking gelling agent" refers to a gelling agent that forms non-covalent crosslinking bonds or physical crosslinking bonds via hydrogen bonding. Hydrogen bonding is a type of electrostatic dipole-dipole attraction between molecules, not a covalent bond to a hydrogen atom. It results from the attractive force between a hydrogen atom covalently bonded to a very electronegative atom such as a N, O, or F atom and another very electronegative atom.

The hydrogen-bond crosslinking gelling agent may include one or more of a galactomannan, gelatin, agarose, or konjac gum, or agar. The hydrogen-bond crosslinking gelling agent preferably includes agar.

The gel composition preferably includes the hydrogen-bond crosslinking gelling agent in a range from about 0.3 percent by weight to about 5 percent by weight.

The gel composition may include a galactomannan in a range from about 0.2 percent by weight to about 5 percent by weight.

The gel composition may include a gelatin in a range from about 0.2 percent by weight to about 5 percent by weight.

The gel composition may include agarose in a range from about 0.2 percent by weight to about 5 percent by weight The gel composition may include konjac gum in a range from about 0.2 percent by weight to about 5 percent by weight.

The gel composition may include agar in a range from about 0.2 percent by weight to about 5 percent by weight.

The term "ionic crosslinking gelling agent" refers to a gelling agent that forms non-covalent crosslinking bonds or physical crosslinking bonds via ionic bonding. Ionic crosslinking involves the association of polymer chains by non-covalent interactions. A crosslinked network is formed when multivalent molecules of opposite charges electrostatically attract each other giving rise to a crosslinked polymeric network.

The ionic crosslinking gelling agent may include low acyl gellan, pectin, kappa carrageenan, iota carrageenan or alginate. The ionic crosslinking gelling agent preferably includes low acyl gellan.

The gel composition may include the ionic crosslinking gelling agent in a range from about 0.3 percent by weight to about 5 percent by weight.

The gel composition may include low acyl gellan in a range from about 0.2 percent by weight to about 5 percent by weight.

The gel composition may include pectin in a range from about 0.2 percent by weight to about 5 percent by weight The gel composition may include kappa carrageenan in a range from about 0.2 percent by weight to about 5 percent by weight The gel composition may include iota carrageenan in a range from about 0.2 percent by weight to about 5 percent by weight.

The gel composition may include alginate in a range from about 0.2 percent by weight to about 5 percent by weight.

The gel composition may include the hydrogen-bond crosslinking gelling agent and ionic crosslinking gelling agent in a ratio of about 3:1 to about 1:3.

The gel composition may further include a viscosifying agent. The viscosifying agent combined with the hydrogen-bond crosslinking gelling agent and the ionic crosslinking gelling agent appears to surprisingly support the solid medium and maintain the gel composition even when the gel composition comprises a high level of glycerol.

The term "viscosifying agent" refers to a compound that, when added homogeneously into a 25° C., 50 percent by weight water/50 percent by weight glycerol mixture, in an amount of 0.3 percent by weight, increases the viscosity without leading to the formation of a gel, the mixture staying or remaining fluid.

The viscosity values recited herein can be measured using a Brookfield RVT viscometer rotating a disc type RV #2 spindle at 25° C. at a speed of 6 revolutions per minute (rpm).

The gel composition preferably includes the viscosifying agent in a range from about 0.2 percent by weight to about 5 percent by weight.

The viscosifying agent may include one or more of xanthan gum, carboxymethyl-cellulose, microcrystalline cellulose, methyl cellulose, gum Arabic, guar gum, lambda carrageenan, or starch. The viscosifying agent may preferably include xanthan gum.

The gel composition may include xanthan gum in a range from about 0.2 percent by weight to about 5 percent by weight.

The gel composition may include carboxymethyl-cellulose in a range from about 0.2 percent by weight to about 5 percent by weight.

The gel composition may include microcrystalline cellulose in a range from about 0.2 percent by weight to about 5 percent by weight.

The gel composition may include methyl cellulose in a range from about 0.2 percent by weight to about 5 percent by weight.

The gel composition may include gum Arabic in a range from about 0.2 percent by weight to about 5 percent by weight.

The gel composition may include guar gum in a range from about 0.2 percent by weight to about 5 percent by weight The gel composition may include lambda carrageenan in a range from about 0.2 percent by weight to about 5 percent by weight.

The gel composition may include starch in a range from about 0.2 percent by weight to about 5 percent by weight.

The gel composition may further include a divalent cation. Preferably the divalent cation includes calcium ions, such as calcium lactate in solution. Divalent cations (such as calcium ions) may assist in the gel formation of compositions that include gelling agents such as the ionic crosslinking gelling agent, for example. The ion effect may assist in the gel formation. The divalent cation may be present in the gel composition in a range from about 0.1 to about 1 percent by weight, or about 0.5 percent by weight to about 1 percent by weight.

The gel composition may further include an acid. The acid may comprise a carboxylic acid. The carboxylic acid may include a ketone group. Preferably the carboxylic acid includes a ketone group having less than about 10 carbon atoms, or less than about 6 carbon atoms or less than about 4 carbon atoms, such as levulinic acid or lactic acid. Preferably this carboxylic acid has three carbon atoms (such as lactic acid). Lactic acid surprisingly improves the stability of the gel composition even over similar carboxylic acids. The carboxylic acid may assist in the gel formation. The carboxylic acid may reduce variation of the alkaloid compound concentration, or the cannabinoid compound concentration, or both the alkaloid compound concentration and the cannabinoid compound within the gel composition during storage. The carboxylic acid may reduce variation of the nicotine concentration within the gel composition during storage.

The gel composition may include a carboxylic acid in a range from about 0.1 percent by weight to about 5 percent by weight.

The gel composition may include lactic acid in a range from about 0.1 percent by weight to about 5 percent by weight.

The gel composition may include levulinic acid in a range from about 0.1 percent by weight to about 5 percent by weight.

The gel composition preferably comprises some water. The gel composition is more stable when the composition comprises some water. Preferably the gel composition comprises at least about 1 percent by weight, or at least about 2 percent by weight, or at least about 5 percent by weight of water. Preferably the gel composition comprises at least about 10 percent by weight or at least about 15 percent by weight water.

Preferably the gel composition comprises between about 8 percent by weight to about 32 percent by weight water. Preferably the gel composition comprises from about 15 percent by weight to about 25 percent by weight water. Preferably the gel composition comprises from about 18 percent by weight to about 22 percent by weight water. Preferably the gel composition comprises about 20 percent by weight water.

Preferably, the aerosol-generating substrate comprises between about 150 mg and about 350 mg of the gel composition.

Preferably, the aerosol-generating substrate comprises a porous medium loaded with the gel composition. Advantages of a porous medium loaded with the gel composition is that the gel composition is retained within the porous medium, and this may aid manufacturing, storage or transport of the gel composition. It may assist in keeping the desired shape of the gel composition, especially during manufacture, transport, or use.

The term "porous" is used herein to refer to a material that provides a plurality of pores or openings that allow the passage of air through the material.

The porous medium may be any suitable porous material able to hold or retain the gel composition. Ideally the porous medium can allow the gel composition to move within it. The porous medium may comprise natural materials, synthetic, or semi-synthetic, or a combination thereof. The porous medium may comprise sheet material, foam, or fibres, for example loose fibres; or a combination thereof. The porous medium may comprise a woven, non-woven, or extruded material, or combinations thereof. Preferably the porous medium comprises cotton, paper, viscose, PLA, or cellulose acetate, of combinations thereof. Preferably the porous medium comprises a sheet material, for example, cotton or cellulose acetate. Preferably the porous medium may comprise a sheet made from cotton fibres.

The porous medium may be crimped or shredded. Preferably, the porous medium is crimped. Alternatively, the porous medium comprises shredded porous medium. The crimping or shredding process may be before or after loading with the gel composition.

Crimping of the sheet material has the benefit of improving the structure to allow passageways through the structure. The passageways though the crimped sheet material assist in loading up gel, retaining gel and also for fluid to pass through the crimped sheet material. Therefore there are advantages of using crimped sheet material as the porous medium.

Shredding gives a high surface area to volume ratio to the medium thus able to absorb gel easily.

The sheet material may be a composite material. Preferably the sheet material is porous. The sheet material may aid manufacture of the tubular element comprising a gel. The sheet material may aid introducing an active agent to the tubular element comprising a gel. The sheet material may help stabilise the structure of the tubular element comprising a gel. The sheet material may assist transport or storage of the gel. Using a sheet material enables, or aids, adding structure to the porous medium for example by crimping of the sheet material.

The porous medium may be a thread. The thread may comprise for example cotton, paper or acetate tow. The thread may also be loaded with gel like any other porous medium. An advantage of using a thread as the porous medium is that it may aid ease of manufacturing.

The thread may be loaded with gel by any known means. The thread may be simply coated with gel, or the thread may be impregnated with gel. In the manufacture, the threads may be impregnated with gel and stored ready for use to be included in the assembly of a tubular element.

The porous medium loaded with the gel composition is preferably provided within a tubular element that forms a part of the aerosol-generating article. Ideally the tubular element may be longer in longitudinal length then in width but not necessarily as it may be one part of a multi-component item that ideally will be longer in its longitudinal length then its width. Typically, the tubular element is cylindrical but not necessarily. For example, the tubular element may have an oval, polygonal like triangular or rectangular or random cross section.

The tubular element preferably comprises a first longitudinal passageway. The tubular element is preferably formed of a wrapper that defines the first longitudinal passageway. The wrapper is preferably a water-resistant wrapper. This water-resistant property the wrapper may be achieved by using a water-resistant material, or by treating the material of the wrapper. It may be achieved by treating one side or both sides of the wrapper. Being water-resistant would assist in not losing structure, stiffness or rigidity. It may also assist in preventing leaks of gel or liquid, especially when gels of a fluid structure are used.

The aerosol-generating article may be provided with an upstream element, upstream of the rod of aerosol-generating substrate. The upstream element may abut the upstream end of the rod of aerosol-generating substrate.

The aerosol-generating article may be provided with a downstream section arranged downstream of the rod of aerosol-generating substrate and in axial alignment with the rod of aerosol-generating substrate. The downstream section may comprise one or more downstream elements.

The aerosol-generating substrate may be heated by an internal heating blade in an electrically heated aerosol-generating device, adapted to be inserted into the aerosol-generating substrate. The aerosol-generating substrate may be inductively heatable by means of a susceptor element arranged within the aerosol-generating substrate.

The provision of an upstream element may advantageously protect the rod of aerosol-generating substrate and prevent physical contact with a gel composition within the rod of aerosol-generating substrate and a susceptor element where present. The upstream element may be an adjacent portion to the rod of aerosol-generating substrate that may also be circumscribed by the embossed portion of the wrapper.

The downstream section may comprise a mouthpiece element. The mouthpiece element may extend all the way to a mouth end of the aerosol-generating article. The mouthpiece element may be an adjacent portion to the rod of aerosol-generating substrate that may also be circumscribed by the embossed portion of the wrapper. The downstream section may further comprise an intermediate hollow section between the mouthpiece element and the rod of aerosol-generating substrate. The intermediate hollow section may comprise an aerosol-cooling element. The aerosol-cooling element may comprise a hollow tubular segment. The intermediate hollow section may comprise a support element, which may comprise a hollow tubular segment. The intermediate hollow section may comprise the aerosol-cooling element and the support element. The support element may be disposed upstream of the aerosol-cooling element. The intermediate hollow section may be an adjacent portion to the rod of aerosol-generating substrate that may also be circumscribed by the embossed portion of the wrapper.

As used herein, the term "hollow tubular segment" is used to denote a generally elongate element defining a lumen or airflow passage along a longitudinal axis thereof. In particular, the term "tubular" will be used in the following with reference to a tubular element having a substantially cylindrical cross-section and defining at least one airflow conduit establishing an uninterrupted fluid communication between an upstream end of the tubular element and a downstream end of the tubular element. However, it will be understood that alternative geometries (for example, alternative cross-sectional shapes) of the tubular segment may be possible.

As used herein, the term "elongate" means that an element has a length dimension that is greater than its width dimension or its diameter dimension, for example twice or more its width dimension or its diameter dimension.

In the context of the present disclosure a hollow tubular segment provides an unrestricted flow channel. This means that the hollow tubular segment provides a negligible level of resistance to draw (RTD). The flow channel should therefore be free from any components that would obstruct the flow of air in a longitudinal direction. Preferably, the flow channel is substantially empty.

The aerosol-generating article may comprise a ventilation zone at a location along the downstream section. In more detail, the aerosol-generating article may comprise a ventilation zone at a location along the aerosol-cooling element. The aerosol-cooling element may comprise or is in the form of a hollow tubular segment, the ventilation zone being provided at a location along the hollow tubular segment of the aerosol-cooling element.

The inventors have found that a satisfactory cooling of the stream of aerosol generated upon heating the aerosol-generating substrate and drawn through one such aerosol-cooling element is achieved by providing a ventilation zone at a location along the hollow tubular segment. Further, the inventors have found that, as will be described in more detail below, by arranging the ventilation zone at a precisely defined location along the length of the aerosol-cooling element and by preferably utilising a hollow tubular segment having a predetermined peripheral wall thickness or internal volume, it may be possible to counter the effects of the increased aerosol dilution caused by the admission of ventilation air into the article.

The rod of aerosol-generating substrate may further comprise a susceptor element. The susceptor element may be an elongate susceptor element. Preferably, the susceptor element extends longitudinally within the aerosol-generating substrate.

These elements of the aerosol-generating article will be described in further detail below.

As defined above, the aerosol-generating article of the present invention comprises a rod of an aerosol-generating substrate. The aerosol-generating substrate may be a solid aerosol-generating substrate.

An elongate susceptor element may be arranged substantially longitudinally within the rod of aerosol-generating substrate and may be in thermal contact with the aerosol-generating substrate.

As used herein with reference to the present invention, the term "susceptor element" refers to a material that can convert electromagnetic energy into heat. When located within a fluctuating electromagnetic field, eddy currents induced in the susceptor element cause heating of the susceptor element. As the elongate susceptor element is located in thermal contact with the aerosol-generating substrate, the aerosol-generating substrate is heated by the susceptor element.

When used for describing the susceptor element, the term "elongate" means that the susceptor element has a length dimension that is greater than its width dimension or its thickness dimension, for example greater than twice its width dimension or its thickness dimension.

The susceptor element is arranged substantially longitudinally within the rod. This means that the length dimension of the elongate susceptor element is arranged to be approximately parallel to the longitudinal direction of the rod, for example within plus or minus 10 degrees of parallel to the longitudinal direction of the rod. The elongate susceptor element may be positioned in a radially central position within the rod, and extends along the longitudinal axis of the rod.

Preferably, the susceptor element extends all the way to a downstream end of the rod of aerosol-generating article. The susceptor element may extend all the way to an upstream end of the rod of aerosol-generating article. The susceptor element may have substantially the same length as the rod of aerosol-generating substrate, and extend from the upstream end of the rod to the downstream end of the rod.

The susceptor element may preferably be in the form of a pin, rod, strip or blade.

The susceptor element may preferably have a length from about 5 millimetres to about 15 millimetres, for example from about 6 millimetres to about 12 millimetres, or from about 8 millimetres to about 10 millimetres.

A ratio between the length of the susceptor element and the overall length of the aerosol-generating article substrate may be from about 0.2 to about 0.35.

Preferably, a ratio between the length of the susceptor element and the overall length of the aerosol-generating article substrate is at least about 0.22, more preferably at least about 0.24, even more preferably at least about 0.26. A ratio between the length of the susceptor element and the overall length of the aerosol-generating article substrate is preferably less than about 0.34, more preferably less than about 0.32, even more preferably less than about 0.3.

A ratio between the length of the susceptor element and the overall length of the aerosol-generating article substrate is preferably from about 0.22 to about 0.34, more preferably from about 0.24 to about 0.34, even more preferably from about 0.26 to about 0.34. A ratio between the length of the susceptor element and the overall length of the aerosol-generating article substrate is preferably from about 0.22 to about 0.32, more preferably from about 0.24 to about 0.32, even more preferably from about 0.26 to about 0.32. A ratio between the length of the susceptor element and the overall length of the aerosol-generating article substrate is preferably from about 0.22 to about 0.3, more preferably from about 0.24 to about 0.3, even more preferably from about 0.26 to about 0.3.

A ratio between the length of the susceptor element and the overall length of the aerosol-generating article substrate may be about 0.27.

The susceptor element preferably has a width from about 1 millimetres to about 5 millimetres.

The susceptor element may generally have a thickness from about 0.01 millimetres to about 2 millimetres, for example from about 0.5 millimetres to about 2 millimetres. The susceptor element preferably has a thickness from about 10 micrometres to about 500 micrometres, more preferably from about 10 micrometres to about 100 micrometres.

If the susceptor element has a constant cross-section, for example a circular cross-section, it has a preferable width or diameter from about 1 millimetre to about 5 millimetres.

If the susceptor element has the form of a strip or blade, the strip or blade preferably has a rectangular shape having a width of preferably from about 2 millimetres to about 8 millimetres, more preferably from about 3 millimetres to about 5 millimetres. By way of example, a susceptor element in the form of a strip of blade may have a width of about 4 millimetres.

If the susceptor element has the form of a strip or blade, the strip or blade preferably has a rectangular shape and a thickness from about 0.03 millimetres to about 0.15 millimetres, more preferably from about 0.05 millimetres to about 0.09 millimetres. By way of example, a susceptor element in the form of a strip of blade may have a thickness of about 0.07 millimetres.

The elongate susceptor element may be in the form of a strip or blade, preferably have a rectangular shape, and have a thickness from about 55 micrometres to about 65 micrometres.

More preferably, the elongate susceptor element may have a thickness from about 57 micrometres to about 63 micrometres. Even more preferably, the elongate susceptor element has a thickness from about 58 micrometres to about 62 micrometres. The elongate susceptor element may have a thickness of about 60 micrometres.

Preferably, the elongate susceptor element may have a length which is the same or shorter than the length of the aerosol-generating substrate. Preferably, the elongate susceptor element has a same length as the aerosol-generating substrate.

The susceptor element may be formed from any material that can be inductively heated to a temperature sufficient to generate an aerosol from the aerosol-generating substrate.

Preferred susceptor elements may comprise a metal or carbon.

A preferred susceptor element may comprise or consist of a ferromagnetic material, for example a ferromagnetic alloy, ferritic iron, or a ferromagnetic steel or stainless steel. A suitable susceptor element may be, or comprise, aluminium. Preferred susceptor elements may be formed from 400 series stainless steels, for example grade 410, or grade 420, or grade 430 stainless steel. Different materials will dissipate different amounts of energy when positioned within electromagnetic fields having similar values of frequency and field strength.

Thus, parameters of the susceptor element such as material type, length, width, and thickness may all be altered to provide a desired power dissipation within a known electromagnetic field. Preferred susceptor elements may be heated to a temperature in excess of 250 degrees Celsius.

Suitable susceptor elements may comprise a non-metallic core with a metal layer disposed on the non-metallic core, for example metallic tracks formed on a surface of a ceramic core. A susceptor element may have a protective external layer, for example a protective ceramic layer or protective glass layer encapsulating the susceptor element. The susceptor element may comprise a protective coating formed by a glass, a ceramic, or an inert metal, formed over a core of susceptor element material.

The susceptor element is arranged in thermal contact with the aerosol-generating substrate. Thus, when the susceptor element heats up the aerosol-generating substrate is heated up and an aerosol is formed. Preferably the susceptor element is arranged in direct physical contact with the aerosol-generating substrate, for example within the aerosol-generating substrate.

The susceptor element may be a multi-material susceptor element and may comprise a first susceptor element material and a second susceptor element material. The first susceptor element material is disposed in intimate physical contact with the second susceptor element material. The second susceptor element material preferably has a Curie temperature that is lower than 500 degrees Celsius. The first susceptor element material is preferably used primarily to heat the susceptor element when the susceptor element is placed in a fluctuating electromagnetic field. Any suitable material may be used. For example the first susceptor element material may be aluminium, or may be a ferrous material such as a stainless steel. The second susceptor element material is preferably used primarily to indicate when the susceptor element has reached a specific temperature, that temperature being the Curie temperature of the second susceptor element material. The Curie temperature of the second susceptor element material can be used to regulate the temperature of the entire susceptor element during operation. Thus, the Curie temperature of the second susceptor element material should be below the ignition point of the aerosol-generating substrate. Suitable materials for the second susceptor element material may include nickel and certain nickel alloys.

By providing a susceptor element having at least a first and a second susceptor element material, with either the second susceptor element material having a Curie temperature and the first susceptor element material not having a Curie temperature, or first and second susceptor element materials having first and second Curie temperatures distinct from one another, the heating of the aerosol-generating substrate and the temperature control of the heating may be separated. The first susceptor element material is preferably a magnetic material having a Curie temperature that is above 500 degrees Celsius. It is desirable from the point of view of heating efficiency that the Curie temperature of the first susceptor element material is above any maximum temperature that the susceptor element should be capable of being heated to. The second Curie temperature is preferably selected to be lower than 400 degrees Celsius, preferably lower than 380 degrees Celsius, or lower than 360 degrees Celsius. It is preferable that the second susceptor element material is a magnetic material selected to have a second Curie temperature that is substantially the same as a desired maximum heating temperature. That is, it is preferable that the second Curie temperature is approximately the same as the temperature that the susceptor element should be heated to in order to generate an aerosol from the aerosol-generating substrate. The second Curie temperature may, for example, be within the range of 200 degrees Celsius to 400 degrees Celsius, or between 250 degrees Celsius and 360 degrees Celsius. The second Curie temperature of the second susceptor element material may, for example, be selected such that, upon being heated by a susceptor element that is at a temperature equal to the second Curie temperature, an overall average temperature of the aerosol-generating substrate does not exceed 240 degrees Celsius.

The aerosol-generating article may comprise a ventilation zone. The aerosol-generating article may have a ventilation level of at least about 5 percent.

The term "ventilation level" is used throughout the present specification to denote a volume ratio between of the airflow admitted into the aerosol-generating article via the ventilation zone (ventilation airflow) and the sum of the aerosol airflow and the ventilation airflow. The greater the ventilation level, the higher the dilution of the aerosol flow delivered to the consumer.

The aerosol-generating article may typically have a ventilation level of at least about 10 percent, preferably at least about 15 percent, more preferably at least about 20 percent.

The aerosol-generating article may have a ventilation level of at least about 25 percent. The aerosol-generating article preferably has a ventilation level of less than about 60 percent. An aerosol-generating article in accordance with the present invention preferably has a ventilation level of less than or equal to about 45 percent. More preferably, an aerosol-generating article in accordance with the present invention has a ventilation level of less than or equal to about 40 percent, even more preferably less than or equal to about 35 percent.

The aerosol-generating article may have a ventilation level of about 30 percent. The aerosol-generating article may have a ventilation level from about 20 percent to about 60 percent, preferably from about 20 percent to about 45 percent, more preferably from about 20 percent to about 40 percent. Alternatively, the aerosol-generating article may have a ventilation level from about 25 percent to about 60 percent, preferably from about 25 percent to about 45 percent, more preferably from about 25 percent to about 40 percent. Alternatively, the aerosol-generating article may have a ventilation level from about 30 percent to about 60 percent, preferably from about 30 percent to about 45 percent, more preferably from about 30 percent to about 40 percent.

The aerosol-generating article may have a ventilation level from about 28 percent to about 42 percent. The aerosol-generating article may have a ventilation level of about 30 percent.

Formation of an aerosol from a gaseous mixture containing various chemical species depends on a delicate interplay between nucleation, evaporation, and condensation, as well as coalescence, all the while accounting for variations in vapour concentration, temperature, and velocity fields. The so-called classical nucleation theory is based on the assumption that a fraction of the molecules in the gas phase are large enough to stay coherent for long times with sufficient probability (for example, a probability of one half). These molecules represent some kind of a critical, threshold molecule clusters among transient molecular aggregates, meaning that, on average, smaller molecule clusters are likely to disintegrate rather quickly into the gas phase, while larger clusters are, on average, likely to grow. Such critical cluster is identified as the key nucleation core from which droplets are expected to grow due to condensation of molecules from the vapour. It is assumed that virgin droplets that just nucleated emerge with a certain original diameter, and then may grow by several orders of magnitude. This is facilitated and may be enhanced by rapid cooling of the surrounding vapour, which induces condensation. In this connection, it helps to bear in mind that evaporation and condensation are two sides of one same mechanism, namely gas-liquid mass transfer. While evaporation relates to net mass transfer from the liquid droplets to the gas phase, condensation is net mass transfer from the gas phase to the droplet phase. Evaporation (or condensation) will make the droplets shrink (or grow), but it will not change the number of droplets.

In this scenario, which may be further complicated by coalescence phenomena, the temperature and rate of cooling can play a critical role in determining how the system responds. In general, different cooling rates may lead to significantly different temporal behaviours as concerns the formation of the liquid phase (droplets), because the nucleation process is typically nonlinear. Without wishing to be bound by theory, it is hypothesised that cooling can cause a rapid increase in the number concentration of droplets, which is followed by a strong, short-lived increase in this growth (nucleation burst). This nucleation burst would appear to be more significant at lower temperatures. Further, it would appear that higher cooling rates may favour an earlier onset of nucleation. By contrast, a reduction of the cooling rate would appear to have a favourable effect on the final size that the aerosol droplets ultimately reach.

The inventors have surprisingly found that the diluting effect on the aerosol—which can be assessed by measuring, in particular, the effect on the delivery of aerosol former (such as glycerol) included in the aerosol-generating substrate) is advantageously minimised when the ventilation level is within the ranges described above. In particular, ventilation levels between 25 percent and 50 percent, and even more preferably between 28 and 42 percent, have been found to lead to particularly satisfactory values of glycerin delivery. At the same time, the extent of nucleation and, as a consequence, the delivery of nicotine and aerosol-former (for example, glycerol) are enhanced.

The inventors have surprisingly found how the favourable effect of enhanced nucleation promoted by the rapid cooling induced by the introduction of ventilation air into the article is capable of significantly countering the less desirable effects of dilution. As such, satisfactory values of aerosol delivery are consistently achieved with aerosol-generating articles in accordance with the invention.

This is particularly advantageous with "short" aerosol-generating articles, such as ones wherein a length of the rod of aerosol-generating substrate is less than about 40 millimetres, preferably less than 25 millimetres, even more preferably less than 20 millimetres, or wherein an overall length of the aerosol-generating article is less than about 70 millimetres, preferably less than about 60 millimetres, even more preferably less than 50 millimetres. As will be appreciated, in such aerosol-generating articles, there is little time and space for the aerosol to form and for the particulate phase of the aerosol to become available for delivery to the consumer.

The aerosol-generating article according to the present invention may have a length from about 35 millimetres to about 100 millimetres.

Preferably, an overall length of an aerosol-generating article in accordance with the invention is at least about 38 millimetres. More preferably, an overall length of an aerosol-generating article in accordance with the invention is at least about 40 millimetres. Even more preferably, an overall length of an aerosol-generating article in accordance with the invention is at least about 42 millimetres.

An overall length of an aerosol-generating article in accordance with the invention is preferably less than or equal to 70 millimetres. More preferably, an overall length of an aerosol-generating article in accordance with the invention is preferably less than or equal to 60 millimetres. Even more preferably, an overall length of an aerosol-generating article in accordance with the invention is preferably less than or equal to 50 millimetres.

An overall length of the aerosol-generating article is preferably from about 38 millimetres to about 70 millimetres, more preferably from about 40 millimetres to about 70 millimetres, even more preferably from about 42 millimetres to about 70 millimetres. Alternatively, an overall length of the aerosol-generating article is preferably from about 38 millimetres to about 60 millimetres, more preferably from about 40 millimetres to about 60 millimetres, even more preferably from about 42 millimetres to about 60 millimetres. Alternatively, an overall length of the aerosol-generating article is preferably from about 38 millimetres to about 50 millimetres, more preferably from about 40 millimetres to about 50 millimetres, even more preferably from about 42 millimetres to about 50 millimetres. Preferably, an overall length of the aerosol-generating article is about 45 millimetres.

The aerosol-generating article preferably has an external diameter of at least 5 millimetres. Preferably, the aerosol-generating article has an external diameter of at least 6 millimetres. More preferably, the aerosol-generating article has an external diameter of at least 7 millimetres.

Preferably, the aerosol-generating article has an external diameter of less than or equal to about 12 millimetres. More preferably, the aerosol-generating article has an external diameter of less than or equal to about 10 millimetres. Even more preferably, the aerosol-generating article has an external diameter of less than or equal to about 8 millimetres.

The aerosol-generating article may have an external diameter from about 5 millimetres to about 12 millimetres, preferably from about 6 millimetres to about 12 millimetres, more preferably from about 7 millimetres to about 12 millimetres. Alternatively, the aerosol-generating article may have an external diameter from about 5 millimetres to about 10 millimetres, preferably from about 6 millimetres to about 10 millimetres, more preferably from about 7 millimetres to about 10 millimetres. Alternatively, the aerosol-generating article may have an external diameter from about 5 millimetres to about 8 millimetres, preferably from about 6 millimetres to about 8 millimetres, more preferably from about 7 millimetres to about 8 millimetres.

A diameter ($D_{ME}$) of the aerosol-generating article at the mouth end is preferably greater than a diameter ($D_{DE}$) of the aerosol-generating article at the distal end. In more detail, a ratio ($D_{ME}/O_{DE}$) between the diameter of the aerosol-generating article at the mouth end and the diameter of the aerosol-generating article at the distal end is preferably at least about 1.005.

Preferably, a ratio ($D_{ME}/O_{DE}$) between the diameter of the aerosol-generating article at the mouth end and the diameter of the aerosol-generating article at the distal end is at least about 1.01. More preferably, a ratio ($D_{ME}/O_{DE}$) between the diameter of the aerosol-generating article at the mouth end and the diameter of the aerosol-generating article at the distal end is at least about 1.02. Even more preferably, a ratio ($D_{ME}/O_{DE}$) between the diameter of the aerosol-generating article at the mouth end and the diameter of the aerosol-generating article at the distal end is at least about 1.05.

A ratio ($D_{ME}/O_{DE}$) between the diameter of the aerosol-generating article at the mouth end and the diameter of the aerosol-generating article at the distal end is preferably less than or equal to about 1.30. More preferably, a ratio ($D_{ME}/O_{DE}$) between the diameter of the aerosol-generating article at the mouth end and the diameter of the aerosol-generating article at the distal end is less than or equal to about 1.25. Even more preferably, a ratio ($D_{ME}/O_{DE}$) between the diameter of the aerosol-generating article at the mouth end and the diameter of the aerosol-generating article at the distal end is less than or equal to about 1.20. Preferably, a ratio ($D_{ME}/O_{DE}$) between the diameter of the aerosol-generating article at the mouth end and the diameter of the aerosol-generating article at the distal end is less than or equal to 1.15 or 1.10.

A ratio ($D_{ME}/O_{DE}$) between the diameter of the aerosol-generating article at the mouth end and the diameter of the aerosol-generating article at the distal end is from about 1.01 to 1.30, more preferably from 1.02 to 1.30, even more preferably from 1.05 to 1.30.

Alternatively, a ratio ($D_{ME}/O_{DE}$) between the diameter of the aerosol-generating article at the mouth end and the diameter of the aerosol-generating article at the distal end may be from about 1.01 to 1.25, more preferably from 1.02 to 1.25, even more preferably from 1.05 to 1.25. Alternatively, a ratio ($D_{ME}/O_{DE}$) between the diameter of the aerosol-generating article at the mouth end and the diameter of the aerosol-generating article at the distal end may be from about 1.01 to 1.20, more preferably from 1.02 to 1.20, even more preferably from 1.05 to 1.20. Alternatively, a ratio ($D_{ME}/O_{DE}$) between the diameter of the aerosol-generating article at the mouth end and the diameter of the aerosol-generating article at the distal end may be from about 1.01 to 1.15, more preferably from 1.02 to 1.15, even more preferably from 1.05 to 1.15.

By way of example, the external diameter of the article may be substantially constant over a distal portion of the article extending from the distal end of the aerosol-generating article for at least about 5 millimetres or at least about 10 millimetres. As an alternative, the external diameter of the article may taper over a distal portion of the article extending from the distal end for at least about 5 millimetres or at least about 10 millimetres.

The elements of the aerosol-generating article, as described above, may be arranged such that the centre of mass of the aerosol-generating article is at least about 60 percent of the way along the length of the aerosol-generating article from the downstream end. More preferably, the elements of the aerosol-generating article are arranged such that the centre of mass of the aerosol-generating article is at least about 62 percent of the way along the length of the aerosol-generating article from the downstream end, more preferably at least about 65 percent of the way along the length of the aerosol-generating article from the downstream end.

Preferably, the centre of mass is no more than about 70 percent of the way along the length of the aerosol-generating article from the downstream end.

Providing an arrangement of elements that gives a centre of mass that is closer to the upstream end than the downstream end may result in an aerosol-generating article having a weight imbalance, with a heavier upstream end. This weight imbalance may advantageously provide haptic feedback to the consumer to enable them to distinguish between the upstream and downstream ends so that the correct end can be inserted into an aerosol-generating device.

An aerosol-generating article in accordance with the present invention may comprise, in linear sequential arrangement, an upstream element, a rod of aerosol-generating substrate located immediately downstream of the upstream element, a support element located immediately downstream of the rod of aerosol-generating substrate, an aerosol-cooling element located immediately downstream of the support element, a mouthpiece element located immediately downstream of the aerosol-cooling element, and an outer wrapper circumscribing the upstream element, the support element, the aerosol-cooling element and the mouthpiece element.

In more detail, the rod of aerosol-generating substrate may abut the upstream element. The support element may abut the rod of aerosol-generating substrate. The aerosol-cooling element may abut the support element. The mouthpiece element may abut the aerosol-cooling element.

The aerosol-generating article may have a substantially cylindrical shape and an outer diameter of about 7.25 millimetres.

The upstream element may have a length of about 5 millimetres, the rod of aerosol-generating article may have a length of about 12 millimetres, the support element may have a length of about 8 millimetres, the mouthpiece element may have a length of about 12 millimetres. Thus, an overall length of the aerosol-generating article may be about 45 millimetres.

The upstream element may be in the form of a plug of cellulose acetate wrapped in stiff plug wrap.

The aerosol-generating article may comprise an elongate susceptor element arranged substantially longitudinally within the rod of aerosol-generating substrate and may be in thermal contact with the aerosol-generating substrate. The susceptor element may be in the form of a strip or blade, may have a length substantially equal to the length of the rod of aerosol-generating substrate and a thickness of about 60 micrometres.

The support element may be in the form of a hollow cellulose acetate tube and may have an internal diameter of about 1.9 millimetres. Thus, a thickness of a peripheral wall of the support element may be about 2.675 millimetres.

The aerosol-cooling element may be in the form of a finer hollow cellulose acetate tube and may have an internal diameter of about 3.25 millimetres. Thus, a thickness of a peripheral wall of the aerosol-cooling element may be about 2 millimetres.

The mouthpiece element may be in the form of a low-density cellulose acetate filter segment.

The rod of aerosol-generating substrate may comprise an aerosol-generating substrate comprising a gel composition.

Features described in relation to one example or embodiment may also be applicable to other examples and embodiments.

Below, there is provided a non-exhaustive list of non-limiting examples. Any one or more of the features of these examples may be combined with any one or more features of another example, embodiment, or aspect described herein.

EX1. An aerosol-generating article for producing an inhalable aerosol upon heating, the aerosol-generating article comprising:

a rod of aerosol-generating substrate, the rod of aerosol-generating substrate optionally comprising an aerosol former content of at least about 5 percent on a dry weight basis; and a wrapper wrapped around at least a portion of the aerosol-generating article, the wrapper comprising an embossed portion circumscribing at least the rod of aerosol-generating substrate.

EX2. An aerosol-generating article according to EX1, wherein the aerosol former has a glycerine content of at least about 10 percent by weight.

EX3. An aerosol-generating article according to EX1 or EX2, wherein the embossed portion of the wrapper is a water resistant wrapper.

EX4. An aerosol-generating article according to any of EX1 to EX3, wherein the embossed portion of the wrapper directly circumscribes the rod of aerosol-generating substrate.

EX5. An aerosol-generating article according to any of EX1 to EX4, wherein the embossed portion fully circumscribes the rod of aerosol-generating substrate around the circumference of the rod.

EX6. An aerosol-generating article according to any of EX1 to EX5, wherein the embossed portion circumscribes the rod of aerosol-generating substrate along at least 80 percent of the length of the rod, preferably along at least 90 percent of the length of the rod, more preferably along 100 percent of the length of the rod.

EX7. An aerosol-generating article according to any of EX1 to EX6, wherein the embossed portion of the wrapper has an embossed outer surface and a debossed inner surface.

EX8. An aerosol-generating article according to any of EX1 to EX7, wherein the embossed portion of the wrapper has a basis weight of from 50 grams per square metre to 100 grams per square metre, preferably from 60 grams per square meter to 90 grams per square meter, most preferably from 75 grams per square meter to 80 grams per square meter.

EX9. An aerosol-generating article according to any of EX1 to EX8, wherein the embossed portion of the wrapper has a plurality of embossments.

EX10. An aerosol-generating article according to EX9, wherein each embossment has a depth of from 0.07 millimetres to 0.21 millimetres.

EX11. An aerosol-generating article according to EX9 or EX10, wherein each embossment has a pitch of from 0.2 millimetres to 0.4 millimetres.

EX12. An aerosol-generating article according to any one of EX9 to EX11, wherein each embossment is a spherical dome.

EX13. An aerosol-generating article according to EX12, wherein the angle between the tangent to the spherical dome and the interception to the horizontal wrap line is from 30 degrees to 60 degrees.

EX14. An aerosol-generating article according to any one of EX9 to EX13, wherein the plurality of embossments are provided in a spaced apart repeating pattern.

EX15. An aerosol-generating article according to any of EX1 to EX14, wherein the embossed portion of the wrapper has a bending moment of from 3 centinewton centimetres to 8 centinewton centimetres at 90 degrees, preferably from 4 centinewton centimetres to 7 centinewton centimetres, more preferably from 5 centinewton centimetres to 6 centinewton centimetres.

EX16. An aerosol-generating article according to any of EX1 to EX15, wherein the embossed portion of the wrapper has an angle memory of from 10 degrees to 40 degrees after 90 degrees bending, preferably from 15 degrees to 35 degrees, more preferably from 20 degrees to 30 degrees.

EX17. An aerosol-generating article according to any of EX1 to EX16, wherein the rod of aerosol-generating substrate comprises a gel composition.

EX18. An aerosol-generating article according to EX17, wherein the gel composition comprises at least one gelling agent, and at least one of an alkaloid compound and a cannabinoid compound.

EX19. An aerosol-generating article according to EX17 or EX18, wherein the gel composition comprises the aerosol former.

EX20. An aerosol-generating article according to any of EX1 to EX19, wherein the rod of aerosol-generating substrate comprises a plug of a porous medium loaded with the gel composition.

EX21. An aerosol-generating article according to EX20, wherein the porous medium is in the form of a crimped sheet.

EX22. An aerosol-generating article according to EX20 or EX21, wherein the porous medium comprises cotton fibres.

EX23. An aerosol-generating article according to any of EX20 to EX22, wherein the gel composition comprises at least 1 percent by weight of nicotine.

EX24. An aerosol-generating article according to any of EX16 to EX22, wherein the gel composition further comprises an acid.

EX25. An aerosol-generating article according to any of EX17 to EX24, wherein the gel composition comprises between 1 percent by weight and 6 percent by weight of the at least one gelling agent.

EX26. An aerosol-generating article according to any of EX1 to EX26, further comprising an elongate susceptor element extending in a longitudinal direction through the rod of aerosol-generating substrate.

EX27. An aerosol-generating article according to any of EX1 to EX26, further comprising an upstream element provided upstream of the rod of aerosol-generating substrate and abutting an upstream end of the rod of aerosol-generating substrate.

EX28. An aerosol-generating article according to any of EX1 to EX27, further comprising a downstream section arranged downstream of the rod of aerosol-generating substrate and in axial alignment with the rod of aerosol-generating substrate, the downstream section comprising one or more downstream elements.

EX29. An aerosol-generating article according to EX 27 or EX28, wherein the upstream element comprises a plug of fibrous filtration material.

EX30. An aerosol-generating article according to any of EX27 to EX28, wherein the resistance to draw of the upstream element is at least 20 millimetres $H_2O$.

EX31. An aerosol-generating article according to any of EX28 to EX30, wherein the downstream section comprises a mouthpiece element comprising a mouthpiece filter segment formed of a fibrous filtration material.

EX32. An aerosol-generating article according to EX31, wherein the resistance to draw of the upstream element is at least 1.5 times the resistance to draw of the mouthpiece element.

EX33. An aerosol-generating article according to EX31 or EX32, wherein the downstream section further comprises an intermediate hollow section between the rod of aerosol-generating substrate and the mouthpiece element, the intermediate hollow section comprising an aerosol-cooling element abutting the upstream end of the mouthpiece element, the aerosol-cooling element comprising a hollow tubular segment defining a longitudinal cavity providing an unrestricted flow channel.

EX34. An aerosol-generating article according to EX33, wherein the intermediate hollow section further comprises a support element between the aerosol-cooling element and the rod of aerosol-generating substrate, the support element comprising a hollow tubular segment defining a longitudinal cavity providing an unrestricted flow channel.

Figure 1:
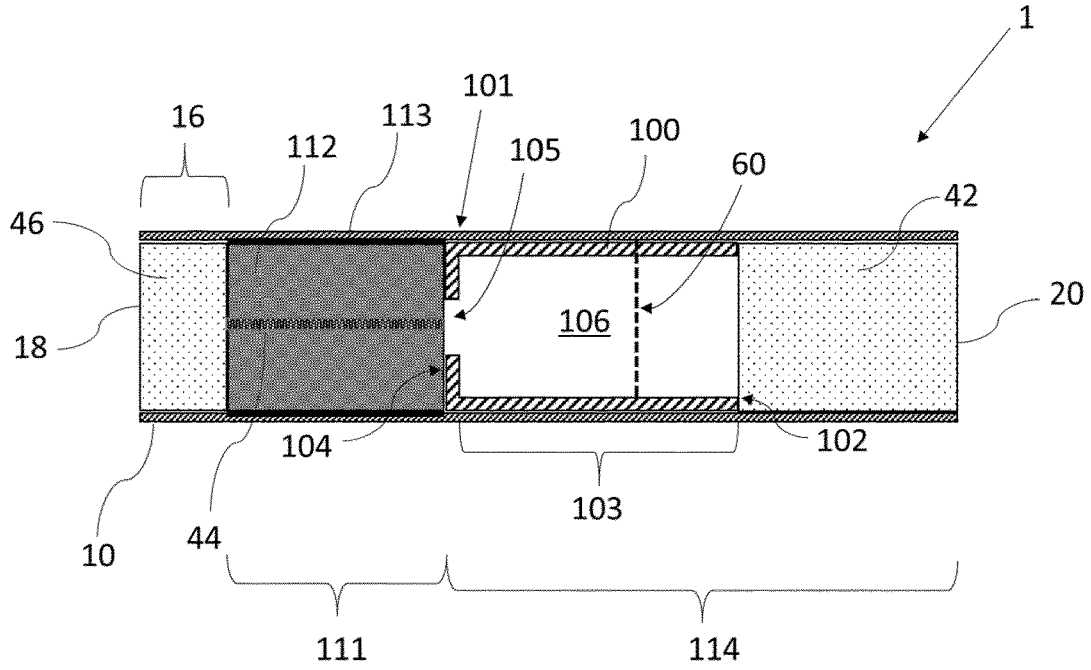
FIG. 1 shows a schematic side sectional view of an aerosol-generating article in accordance with a first embodiment of the invention.

Embodiments of the invention will now be described in detail, by way of example only, with reference to the accompanying drawings, in which:

FIG. 1 shows an aerosol-generating article 1 article in accordance with a first embodiment of the invention. The aerosol-generating article 1 comprises a rod 111 of aerosol-generating substrate 112 and a downstream section 114 at a location downstream of the rod 111 of aerosol-generating substrate 112. Further, the aerosol-generating article 1 comprises an upstream section 16 at a location upstream of the rod 111 of aerosol-generating substrate 112. Thus, the aerosol-generating article 1 extends from an upstream or distal end 18 to a downstream or mouth end 20.

The aerosol-generating article has an overall length of about 45 millimetres.

The downstream section 114 comprises a tubular element 100 located immediately downstream of the rod 111 of aerosol-generating substrate 112, the tubular element 100 being in longitudinal alignment with the rod 111 of aerosol-generating substrate 112. In the embodiment of FIG. 1, the upstream end of the tubular element 100 abuts the downstream end of the rod 111 of aerosol-generating substrate 12 and in particular the downstream end of the rod 111.

The rod 111 comprises an aerosol-generating substrate 112 comprising a porous medium loaded with a gel composition as defined above. An example of a suitable gel composition is shown below in Table 1:

TABLE 1

| Gel composition | |
|---|---|
| Component | Amount (% by weight) |
| Water | 20 |
| Glycerol | 73.5 |
| Nicotine | 1.5 |
| Gelling agent | 3 |
| Lactic acid | 1 |
| Divalent cations | 1 |

In addition, the downstream section 114 comprises a mouthpiece element 42 at a location downstream of the tubular element 100. In more detail, the mouthpiece element 42 is positioned immediately downstream of the tubular element 100. As shown in FIG. 1, an upstream end of the mouthpiece element 42 abuts the downstream end 40 of the tubular element 100.

The mouthpiece element 42 is provided in the form of a cylindrical plug of low-density cellulose acetate. The mouthpiece element 42 has a length of about 12 millimetres and an external diameter of about 7.25 millimetres. The RTD of the mouthpiece element 42 is about 12 millimetres $H_2O$.

The aerosol-generating article 1 comprises a ventilation zone 60 provided at a location along the tubular element 100. In more detail, the ventilation zone is provided at about 4 millimetres from the downstream end of the tubular element 100. A ventilation level of the aerosol-generating article 1 is about 40 percent.

The rod 111 comprises an aerosol-generating substrate 112 of one of the types described above. The aerosol-generating substrate 112 may substantially define the structure and dimensions of the rod 111. The rod 111 comprising the aerosol-generating substrate has an external diameter of about 7.25 millimetres and a length of about 12 millimetres.

The aerosol-generating article 1 further comprises a wrapper 10 with an embossed portion 113 circumscribing the rod 111 of aerosol-generating substrate 112. In the embodiment of FIG. 1, the embossed portion 113 of the wrapper 10 fully circumscribes the rod 111 of aerosol-generating substrate around the circumference of the rod 111. In this embodiment, the embossed portion 113 of the wrapper 10 circumscribes the rod 11 of aerosol-generating substrate along the full length of the rod 111.

In this embodiment, the wrapper 10 extends along the full length of the aerosol-generating article 1, from an upstream end 18 to a downstream end 20. The wrapper 10 fully circumscribes the upstream element 46, the rod 111 of aerosol-generating substrate 112, the tubular element 100 and the mouthpiece 42 around their circumferences. The wrapper 10 defines an outer surface of the aerosol-generating article 1.

The representation of the embossed portion 113 in FIG. 1 is for schematic purposes only and therefore does not show the embossments themselves or their arrangement on the embossed portion 113. The embossed portion 113 will be described in more detail below with respect to FIGS. 4 and 5.

The rod 111 of aerosol-generating substrate 112 also comprises an elongate susceptor element 44 within the aerosol-generating substrate 112. In more detail, the susceptor element 44 is arranged substantially longitudinally within the aerosol-generating substrate 112, such as to be approximately parallel to the longitudinal direction of the rod 111. As shown in the drawing of FIG. 1, the susceptor element 44 is positioned in a radially central position within the rod and extends effectively along the longitudinal axis of the rod 111.

The susceptor element 44 extends all the way from an upstream end to a downstream end of the rod 111. In effect, the susceptor element 44 has substantially the same length as the rod 111 comprising the aerosol-generating substrate 112.

In the embodiment of FIG. 1, the susceptor element 44 is provided in the form of a strip and has a length of about 12 millimetres, a thickness of about 60 micrometres, and a width of about 4 millimetres.

The upstream section 16 comprises an upstream element 46 located immediately upstream of the rod 111 of aerosol-generating substrate 112, the upstream element 46 being in longitudinal alignment with the rod 111 of aerosol-generating substrate 112. In the embodiment of FIG. 1, the downstream end of the upstream element 46 abuts the upstream end of the rod 111 and in particular the upstream end of the aerosol-generating substrate 112. This advantageously prevents the susceptor element 44 from being dislodged. Further, this ensures that the consumer cannot accidentally contact the heated susceptor element 44 after use.

The upstream element 46 is provided in the form of a cylindrical plug of cellulose acetate circumscribed by a stiff wrapper 10. The upstream element 46 has a length of about 5 millimetres. The RTD of the upstream element 46 is about 30 millimetres $H_2O$.

The tubular element 100 comprises a tubular body 103 defining a cavity 106 extending from a first end 101 of the tubular body 103 to a second end 102 of the tubular body 103. The tubular element 100 also comprises a folded end portion forming a first end wall 104 at the first end 101 of the tubular body 103. The first end wall 104 delimits and opening 105, which permits airflow between the cavity 106 and the exterior of the tubular element 100. In particular, the embodiment of FIG. 1 is configured so that aerosol may flow from the rod 111 of aerosol-generating substrate 112 through the opening 105 into the cavity 106.

The cavity 106 of the tubular body 103 is substantially empty, and so substantially unrestricted airflow is enabled along the cavity 106. Consequently, the RTD of the tubular element 100 can be localised at a specific longitudinal position of the tubular element 100—namely, at the first end wall 104—and can be controlled through the chosen configuration of the first end wall 104 and its corresponding opening 105. In the embodiment of FIG. 1, the RTD of the tubular element 100 (which is essentially the RTD of the first end wall 104) is substantially 10 millimetres $H_2O$. In the embodiment of FIG. 1, the tubular element 100 has a length of about 16 millimetres, an external diameter of about 7.25 millimetres, and an internal diameter ($D_{FTS}$) of about 6.5 millimetres. Thus, a thickness of a peripheral wall of the tubular body 103 is about 0.75 millimetres.

As shown in FIG. 1, the first end wall 104 extends substantially transverse to the longitudinal direction of the aerosol generating article 1 and the longitudinal direction of the tubular element 100. The opening 105 is the only opening in the first end wall 104 and the opening 105 is positioned in a generally radially central position of the tubular element 100. Consequently, the first end wall 104 is generally annular shaped.

The combination of the first end wall 104 and its corresponding opening 105 provide an effective barrier arrangement which may restrict movement of the aerosol-generating substrate, whilst also enabling one or both of air and aerosol to flow from the rod 111 of aerosol-generating substrate 112 and through the opening 105 into the cavity 106. The opening 105 is generally aligned with the radially central position of the susceptor element 44 of the rod 111 of aerosol-generating substrate 112. This may be advantageous as it helps to keep a distance between the first end wall 105 and the susceptor, and thus mitigate undesirable heating of the first end wall 105. This may also be advantageous as it can provide direct unimpeded downstream flow of aerosol produced by the portion of the aerosol-generating substrate in close proximity to the susceptor element 44.

The first end wall 104 is formed by folding an end portion of the tubular element 100 about a fold point. The fold point generally corresponds to the first end of the tubular body 103 of the tubular element 100.

Figure 2:
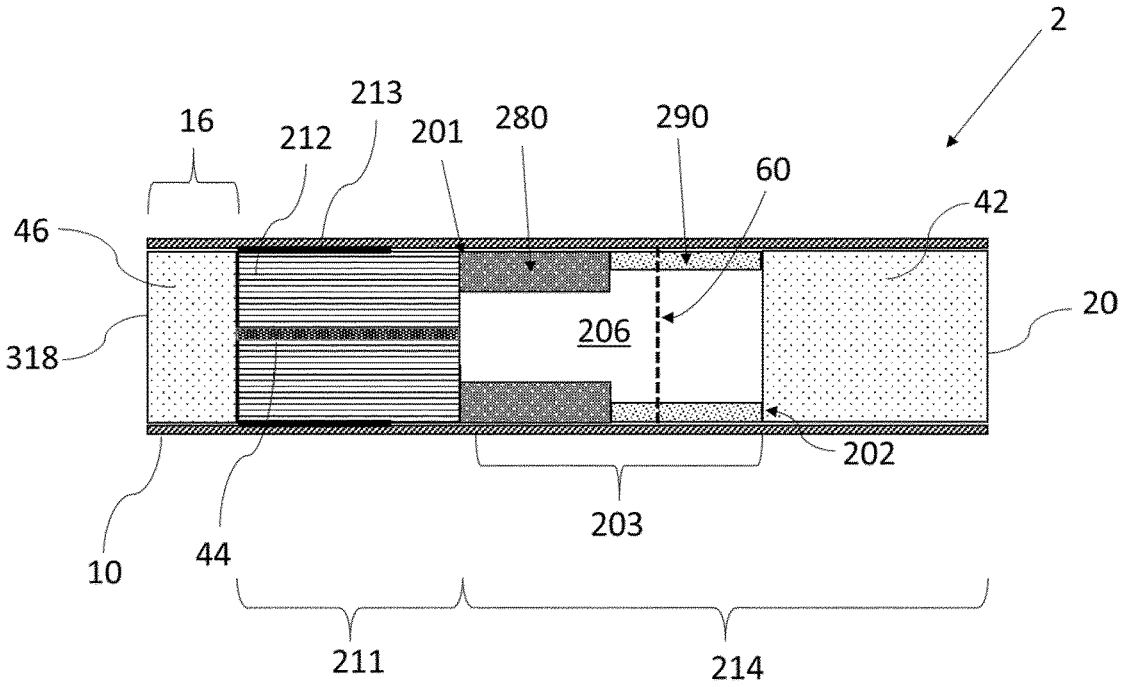
FIG. 2 shows a schematic side sectional view of an aerosol-generating article in accordance with a second embodiment of the invention.

FIG. 2 shows an aerosol-generating article 2 in accordance with a second embodiment of the invention. The aerosol-generating article 2 has similarities with the aerosol-generating article 1 of the first embodiment of the invention in FIG. 1, and like-for-like reference numerals are used where appropriate. However, the aerosol-generating article 2 of FIG. 2 does not comprise a tubular element. In particular, in contrast to the aerosol-generating article 1 of FIG. 1, the aerosol-generating article 2 of FIG. 2 does not comprise a tubular element 100 between the first element 100 and the mouthpiece element 42. Instead, the aerosol-generating article 2 of FIG. 2 comprises two hollow acetate tubes between the first element 100 and the mouthpiece element 42. These are a first hollow acetate tube 280 located immediately downstream of, and in longitudinal alignment with a rod 211 of aerosol-generating substrate 212 and a second hollow acetate tube 290 located immediately downstream of the first hollow acetate tube 280.

The first hollow acetate tube 280 and the second hollow acetate tube 290 define a tubular body 203 with a cavity 206 extending from a first upstream end 201 of the tubular body 203 to a second downstream end 202 of the tubular body 203.

The first hollow acetate tube 280 defines a support element. The first upstream end of the first hollow acetate tube abuts the downstream end of the rod 211 of aerosol-generating substrate 212.

The second hollow acetate tube 290 defines an aerosol-cooling element which abuts the downstream end of the first hollow acetate tube 280.

The internal cavity 206 of the tubular body 203 defined by the first hollow acetate tube 280 and the second hollow acetate tube 290 is substantially empty, and so substantially unrestricted airflow is enabled along the cavity 206.

As a whole, the tubular body 203 does not substantially contribute to the overall RTD of the aerosol-generating article. An RTD of the tubular body 203 as a whole is substantially 0 millimetres $H_2O$.

The first hollow acetate tube 280 has a length of about 8 millimetres, an external diameter of about 7.25 millimetres, and an internal diameter ($D_{FTS}$) of about 1.9 millimetres. Thus, a thickness of a peripheral wall of the first hollow acetate tube 280 is about 2.67 millimetres.

The second hollow acetate tube 290 has a length of about 8 millimetres, an external diameter of about 7.25 millimetres, and an internal diameter ($D_{STS}$) of about 3.25 millimetres. Thus, a thickness of a peripheral wall of the second hollow acetate tube 290 is about 2 millimetres. Thus, a ratio between the internal diameter ($D_{FTS}$) of the first hollow acetate tube 280 and the internal diameter ($D_{STS}$) of the second hollow acetate tube 290 is about 0.75.

The aerosol-generating article 2 comprises a ventilation zone 60 provided at a location along the second hollow acetate tube 290. In more detail, the ventilation zone is provided at about 2 millimetres from the upstream end of the second hollow acetate tube 290. A ventilation level of the aerosol-generating article 10 is about 25 percent.

The aerosol-generating article 2 may further comprise a wrapper 10 with an embossed portion 13 circumscribing the rod 211 of aerosol-generating substrate 212. In this embodiment of FIG. 1, the embossed portion 213 of the wrapper 10 fully circumscribes the rod 211 of aerosol-generating substrate 212 around the circumference of the rod 211. In this embodiment, the embossed portion 213 of the wrapper 10 circumscribes the rod 211 of aerosol-generating substrate 212 along only a portion of the length of the rod 211.

In this embodiment, the wrapper 10 extends along the full length of the aerosol-generating article 2, from an upstream end 18 to a downstream end 20. The wrapper 10 fully circumscribes the upstream element 46, the rod 211 of aerosol-generating substrate 212, the first hollow acetate tube 280, the second hollow acetate tube 290 and the mouthpiece 42 around their circumferences. The wrapper 10 defines an outer surface of the aerosol-generating article 2.

The representation of the embossed portion 213 in FIG. 2 is for schematic purposes only and therefore does not show the embossments themselves or their arrangement on the embossed portion 213. The embossed portion 213 will be described in more detail below with respect to FIGS. 4 and 5.

Figure 3:
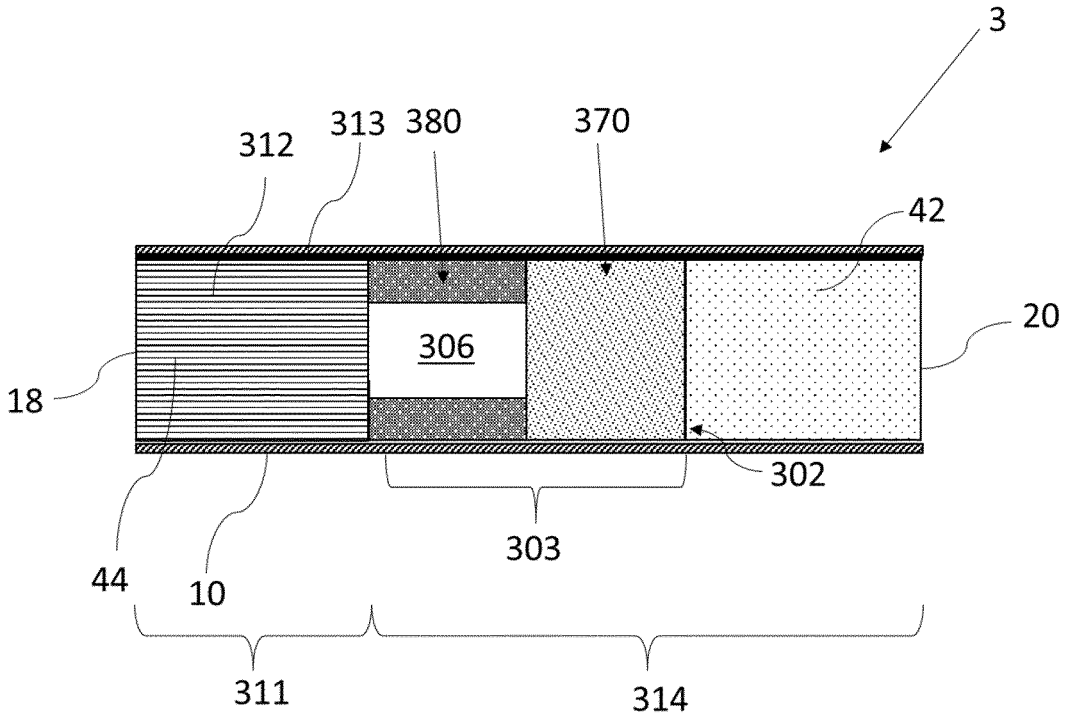
FIG. 3 shows a schematic side sectional view of an aerosol-generating article in accordance with a third embodiment of the invention.

FIG. 3 shows an aerosol-generating article 3 in accordance with a third embodiment of the invention. Unlike the embodiments of FIGS. 1 and 2, the aerosol-generating article 3 of the third embodiment does not comprise any form of upstream element 46 upstream of a rod 311 of aerosol-generating substrate 312. Consequently, the upstream or distal end 318 of the aerosol-generating article 3 is defined by the rod 311 of aerosol-generating substrate 312. Furthermore, in the third embodiment of the invention the rod 311 of aerosol-generating substrate 312 does not comprise a susceptor element 44 located within the aerosol-generating substrate 312. Such an aerosol-generating article 3 may therefore be one which is configured to receive a heater blade of an aerosol-generating device. The heater blade may be inserted into the aerosol-generating substrate 312 through the upstream end 318 of the aerosol-generating article 3.

The aerosol-generating article 3 of the third embodiment has a hollow acetate tube 380 substantially the same as the first hollow acetate tube 280 of the aerosol-generating article 2 of the second embodiment. This hollow acetate tube 380 defines a support element and has a cavity 306 extending from an upstream end of the of the hollow acetate tube 380 to a downstream end of the hollow acetate tube 380.

The cavity 306 of the hollow acetate tube 380 is substantially empty, and so substantially unrestricted airflow is enabled along the cavity 306.

The hollow acetate tube 380 does not substantially contribute to the overall RTD of the aerosol-generating article. An RTD of the intermediate hollow section 250 as a whole is substantially 0 millimetres $H_2O$.

The aerosol-generating article 3 of the third embodiment comprises an aerosol-cooling element 370 located immediately downstream of the hollow acetate tube 380, the aerosol-cooling element 370 being in longitudinal alignment with the rod 311 of aerosol-generating substrate 312 and the hollow acetate tube 380. In more detail, the upstream end of the aerosol-cooling element 370 abuts the downstream end of the hollow acetate tube 380.

In contrast to the aerosol cooling element (hollow acetate tube 290) of the aerosol-generating device 2 of the second embodiment, the aerosol-cooling element 370 comprises a plurality of longitudinally extending channels which offer a low or substantially null resistance to the passage of air through the rod. In more detail, the aerosol-cooling element 370 is formed from a preferably non-porous sheet material selected from the group comprising a metallic foil, a polymeric sheet, and a substantially non-porous paper or cardboard. In particular, in the embodiment illustrated in FIG. 3, the aerosol-cooling element 370 is provided in the form of a crimped and gathered sheet of polylactic acid (PLA). The aerosol-cooling element 370 has a length of about 8 millimetres, and an external diameter of about 7.25 millimetres.

The aerosol-generating article 3 may further comprise a wrapper 10 with an embossed portion 313 circumscribing the rod 311 of aerosol-generating substrate 312. In this embodiment of FIG. 3, the embossed portion 313 of the wrapper 10 circumscribes the rod 311 of aerosol-generating substrate around only a portion of the circumference of the rod 311. In this embodiment, the embossed portion 313 of the wrapper 10 circumscribes the rod 311 of aerosol-generating substrate along the full length of the aerosol-generating article 3.

In this embodiment, the paper wrapper 10 extends along the full length of the aerosol-generating article 3, from an upstream end 18 to a downstream end 20. The paper wrapper 10 fully circumscribes the rod 311 of aerosol-generating substrate 312, the hollow acetate tube 380, the aerosol-cooling element 370 and the mouthpiece 42 around their circumferences. The paper wrapper 10 defines an outer surface of the aerosol-generating article 3.

The representation of the embossed portion 313 in FIG. 3 is for schematic purposes only and therefore does not show the embossments themselves or their arrangement on the embossed portion 313. The embossed portion 313 will be described in more detail below with respect to FIGS. 4 and 5.

Figure 4:
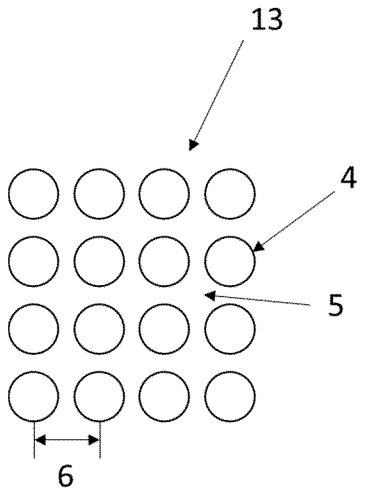
FIG. 4 shows an aerial view of a pattern of embossments on an embossed portion of a wrapper to be used with an aerosol-generating article of an embodiment of the invention.
Figure 5:
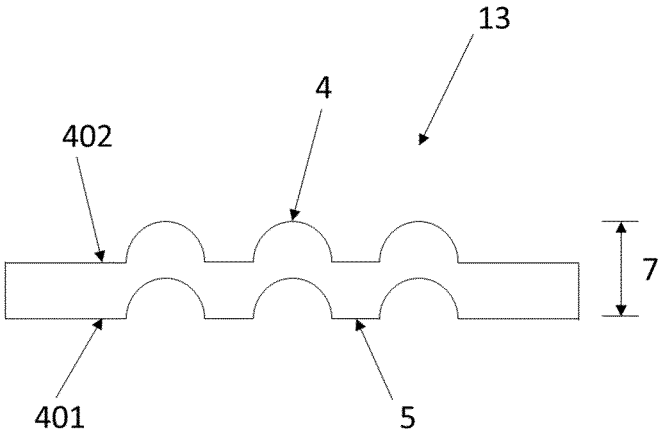
FIG. 5 shows a schematic side sectional view of a pattern of embossments on an embossed portion of a wrapper to be used with an aerosol-generating article of an embodiment of the invention.

FIGS. 4 and 5 respectively show an aerial view and a side sectional view of a pattern of embossments on an embossed portion of a wrapper to be used with an aerosol-generating article of an embodiment of the invention. The embossed portion 13 shown in both FIGS. 4 and 5 is in a unwrapped state. The embossed portion 13 has a plurality of embossments 4 spaced apart in a repeating pattern. Debossments 5 are defined by the space between each embossment where the wrapper 10 has not been embossed. Each embossment is a spherical dome. The embossed portion 13 is further defined by the pitch 6 of the embossments 4. This pitch 6 is defined by the distance between the centre of two adjacent embossments 4. An embossment 4 is also defined by its depth 7. The depth 7 of an embossment is equal to the thickness of the unembossed wrapper 10 plus the height of the protrusion of an embossment 4. Each embossment has substantially the same depth, pitch and profile. The embossed portion 13 has an inner surface 401 which when assembled is in direct or indirect contact with an aerosol-generating article. It is the debossments 5 that are in direct or indirect contact with the aerosol-generating article. The inner surface of the embossments 4 are spaced away from the aerosol-generating article. The embossed portion also has an outer surface 402.

The invention claimed is:

1. An aerosol-generating article for producing an inhalable aerosol upon heating, the aerosol-generating article comprising:

a rod of aerosol-generating substrate comprising an aerosol former content of at least about 5 percent on a dry weight basis; and a wrapper wrapped around at least a portion of the aerosol-generating article, the wrapper comprising an embossed portion circumscribing at least the rod of aerosol-generating substrate, wherein the embossed portion of the wrapper circumscribes the rod of aerosol-generating substrate along at least 80 percent of a length of the rod, and wherein the rod of aerosol-generating substrate further comprises a gel composition.

2. The aerosol-generating article according to claim 1, wherein the rod of aerosol-forming substrate further comprises an aerosol former content of at least 15 percent on a dry weight basis.

3. The aerosol-generating article according to claim 1, wherein the wrapper is a paper wrapper.

4. The aerosol-generating article according to claim 1, wherein the aerosol former has a glycerine content of at least about 10 percent by weight.

5. The aerosol-generating article according to claim 1, wherein the embossed portion of the wrapper is a water-resistant wrapper.

6. The aerosol-generating article according to claim 1, wherein the embossed portion of the wrapper directly circumscribes the rod of aerosol-generating substrate.

7. The aerosol-generating article according to claim 1, wherein the embossed portion fully circumscribes the rod of aerosol-generating substrate around a circumference of the rod.

8. The aerosol-generating article according to claim 1, wherein the embossed portion circumscribes the rod of aerosol-generating substrate along at least 90 percent of the length of the rod.

9. The aerosol-generating article according to claim 1, wherein the embossed portion of the wrapper has an embossed outer surface and a debossed inner surface.

10. The aerosol-generating article according to claim 1, wherein the embossed portion of the wrapper has a basis weight of from 50 grams per square meter to 100 grams per square meter.

11. The aerosol-generating article according to claim 1, wherein the embossed portion of the wrapper has a basis weight of from 75 grams per square meter to 80 grams per square meter.

12. The aerosol-generating article according to claim 1, wherein the embossed portion of the wrapper has a plurality of embossments.

13. The aerosol-generating article according to claim 1, wherein the embossed portion of the wrapper has a bending moment of from 3 centinewton centimeters to 8 centinewton centimeters at 90 degrees.

14. The aerosol-generating article according to claim 1, wherein the embossed portion of the wrapper has a bending moment of from 5 centinewton centimeters to 6 centinewton centimeters at 90 degrees.

15. The aerosol-generating article according to claim 1, wherein the embossed portion of the wrapper has an angle memory of from 10 degrees to 40 degrees after 90 degrees bending.

16. The aerosol-generating article according to claim 1, wherein the embossed portion of the wrapper has an angle memory of from 20 degrees to 30 degrees after 90 degrees bending.

17. The aerosol-generating article according to claim 16, wherein the gel composition comprises at least one gelling agent, and at least one of an alkaloid compound and a cannabinoid compound.

18. The aerosol-generating article according to claim 16, wherein the gel composition comprises the aerosol former.

19. The aerosol-generating article according to claim 16, further comprising an elongate susceptor element extending in a longitudinal direction through the rod of aerosol-generating substrate.

20. The aerosol-generating article according to claim 12,
wherein each embossment of the plurality of embossments is a spherical dome, and
wherein the plurality of embossments are spaced apart in a repeating pattern.

* * * * *